US011453015B2

(12) United States Patent
Lüersmann et al.

(10) Patent No.: US 11,453,015 B2
(45) Date of Patent: Sep. 27, 2022

(54) ROTOR FOR A CENTRIFUGAL SEPARATOR AND CENTRIFUGAL SEPARATOR

(71) Applicant: HENGST SE, Münster (DE)

(72) Inventors: Markus Lüersmann, Münster (DE); Eike Stitterich, Senden (DE); Tom Klaver, Cologne (DE)

(73) Assignee: HENGST SE, Munster (DE)

( * ) Notice: Subject to any disclaimer, the term of this patent is extended or adjusted under 35 U.S.C. 154(b) by 264 days.

(21) Appl. No.: 16/979,831

(22) PCT Filed: Mar. 11, 2019

(86) PCT No.: PCT/EP2019/055958

§ 371 (c)(1),
(2) Date: Sep. 10, 2020

(87) PCT Pub. No.: WO2019/175077

PCT Pub. Date: Sep. 19, 2019

(65) Prior Publication Data

US 2021/0046490 A1 Feb. 18, 2021

(30) Foreign Application Priority Data

Mar. 12, 2018 (DE) ..... 102018105586.2

(51) Int. Cl.
*B04B 1/04* (2006.01)
*B04B 7/14* (2006.01)
(Continued)

(52) U.S. Cl.
CPC ..... *B04B 7/14* (2013.01); *B04B 5/005* (2013.01); *B04B 5/12* (2013.01); *F01M 13/04* (2013.01);
(Continued)

(58) Field of Classification Search
CPC .. B04B 1/08; B04B 5/005; F01M 2013/0422; B01D 45/14
(Continued)

(56) References Cited

U.S. PATENT DOCUMENTS

X779099 1/1905 Remmerfelt
3,335,946 A * 8/1967 Putterlik ..... B04B 7/14 494/73
(Continued)

FOREIGN PATENT DOCUMENTS

DE 102015119616 A1 5/2017
EP 2334439 B1 12/2015
(Continued)

OTHER PUBLICATIONS

International Search Report; priority document.

*Primary Examiner* — Long T Tran
*Assistant Examiner* — James J Kim
(74) *Attorney, Agent, or Firm* — Greer, Burns & Crain, Ltd.

(57) ABSTRACT

A rotor of a centrifugal separator, including a central shaft, a plurality of identical discs arranged in a stack on the central shaft, the central shaft having on an outer circumference an engagement contour for a rotationally fixed, axially slidable engagement with a corresponding contour on an inner circumference of the discs, the engagement and corresponding contours engageable with one another in multiple rotational positions at a circumferential distance from one another, and each disc having spacing elements situated at a disc circumferential distance from one another, which spacing elements hold each two adjacent discs at an axial distance from one another, forming an intermediate flow gap having a gap dimension. The spacing elements are formed and configured such that, via different rotational positions relative to one another of adjacent discs, at least
(Continued)

two different axial dimensions of the flow gap between adjacent discs may be set.

20 Claims, 15 Drawing Sheets

(51) Int. Cl.
*B04B 5/00* (2006.01)
*B04B 5/12* (2006.01)
*F01M 13/04* (2006.01)

(52) U.S. Cl.
CPC ..... *B04B 2005/125* (2013.01); *F01M 2013/0422* (2013.01)

(58) Field of Classification Search
USPC ..... 494/68
See application file for complete search history.

(56) References Cited

U.S. PATENT DOCUMENTS

| | | | | |
|---|---|---|---|---|
| 8,562,503 | B2 * | 10/2013 | Rudman | B04B 7/14 494/73 |
| 8,678,989 | B2 * | 3/2014 | Rudman | B04B 7/14 494/73 |
| 9,849,467 | B2 * | 12/2017 | Hagqvist | B04B 7/14 |
| 2011/0195832 | A1 | 8/2011 | Rudman et al. | |
| 2015/0119225 | A1 * | 4/2015 | Inge | B04B 7/14 494/70 |
| 2017/0120176 | A1 | 5/2017 | Ishida et al. | |
| 2018/0318847 | A1 | 11/2018 | Lüersmann et al. | |

FOREIGN PATENT DOCUMENTS

| | | | |
|---|---|---|---|
| EP | 3124120 | A1 | 2/2017 |
| EP | 2349578 | B1 | 5/2017 |

* cited by examiner

ROTOR FOR A CENTRIFUGAL SEPARATOR AND CENTRIFUGAL SEPARATOR

CROSS-REFERENCES TO RELATED APPLICATIONS

This application claims the benefit of the International Application No. PCT/EP2019/055958, filed on Mar. 11, 2019, and of the German patent application No. 102018105586.2 filed on Mar. 12, 2018, the entire disclosures of which are incorporated herein by way of reference.

FIELD OF THE INVENTION

The present invention relates to a rotor of a centrifugal separator, the rotor having a central shaft on which there is situated a disc stack of a plurality of identical discs, the shaft having on its outer circumference an engagement contour for rotationally fixed, axially slidable engagement with a corresponding contour on the inner circumference of the discs of the disc stack, the engagement contour and the corresponding contour being capable of being brought into engagement with one another in a plurality of rotational positions at a distance from one another in the circumferential direction, and each disc having spacing elements at a distance from one another in the disc circumferential direction that hold each two adjacent discs at an axial distance from one another with a specifiable gap dimension, forming an intermediate flow gap. In addition, the present invention relates to a centrifugal separator.

BACKGROUND OF THE INVENTION

A rotor of the type indicated above is known from DE 10 2015 119 616 A1. Here, the discs have the shape of a frustum-shaped jacket, and the radially outer part of the discs, running at an angle, is realized as a closed surface. The radially inner, flat region of the discs is provided on its inner circumference with the contour corresponding to the engagement contour of the central shaft. Radially outward from the corresponding contour, distributed in the circumferential direction there are situated a plurality of flow openings through which, during operation of the rotor, a gas to be cleaned flows in axially, and from where the gas is then diverted outward into the flow gaps between the adjacent discs. For the mutual spacing of the discs, here an arrangement is used of spacing webs that run over the lower side of the obliquely oriented region of each disc.

EP 2 349 578 B1 describes a separating disc that is adapted to be included in a disc package of a centrifuge rotor. The separating disc has a tapered shape, and extends around an axis of rotation and along a tapered rotating symmetrical surface along the axis of rotation. In addition, the separating disc has an inner surface and an outer surface. The separating disc is made of a material, the separating disc being configured in such a way that it has an intermediate space between the separating disc and an adjacent separating disc in the disc package, and thus includes first projections that extend outward from the tapered rotating symmetrical surface, and includes second projections that extend inward from the tapered rotating symmetrical surface. Each first and second projection defines a contact zone that is adapted to contact an adjacent separating disc in the disc package. Here, the contact zones of the first projections are offset relative to the contact zones of the second projections, seen in a normal direction relative to the outer surface. The first and second projections are provided one after the other in a peripheral direction of the separating disc. What is essential here is that the tapered shape and the projections of the separating disc were provided by pressing a blank made of the material against a tool part that has a shape that corresponds to the tapered shape having the projections of the pressed separating disc.

EP 2 334 439 B1 shows a disc package for a centrifuge rotor of a centrifugal separator designed for the separation of components in a supplied medium, the disc package having a multiplicity of separating discs that are set one on the other in the disc package. Each separating disc extends around an axis of rotation, and has a conical shape having an inner surface and an outer surface along the axis of rotation. Each separating disc is made of at least one material, the separating discs in the disc package being pre-tensioned against one another with a pre-tensioning force. The separating discs have a multiplicity of first separating discs, each of which has a number of distancing elements. Each separating disc has at least one segment not having distancing elements. The first separating discs are positioned in polar fashion in such a way that the distancing elements of the one separating disc lie on the segment of an adjacent separating disc. Here it is essential that the distancing elements include a number of pairs of distancing elements, the pairs each including a first distancing element extending away from the outer surface and a second distancing element extending away from the inner surface, the first and second distancing element being offset relative to one another, seen in a normal direction in relation to the outer surface, and are provided one after the other in a peripheral direction of the first separating disc, and that the pre-tensioning force brings about an abutment force between the distancing elements and the adjacent separating disc, and brings about an elastic deformation of the segment of at least one of the separating discs, and that this elastic deformation ensures, during the rotation of the disc package, an increase in the abutment force between the distancing elements and the adjacent separating disc.

In all of the known rotors and discs described above, it is regarded as disadvantageous that the axial spacing between adjacent discs in the disc stack is defined at a single value that is specified by the height of the spacing webs or of the first and second projections or of the distancing elements on the discs. If a different axial spacing between adjacent discs in the disc stack is desired or required, the production of new discs having spacing webs, or first and second projections, or distancing elements, having a different, smaller or larger, axial height is required. However, such a production is disadvantageous with regard to the required tool investment and the differentiation of parts in the assembly of the disc stack, and is, in particular, not cost-efficient.

SUMMARY OF THE INVENTION

Therefore, the present invention is based on an object of providing a rotor of the type named above that avoids the stated disadvantages and in which it is possible, in a technically simple and economically advantageous manner, to realize different spacings between the discs in the disc stack. In addition, a corresponding centrifugal separator is to be provided.

The solution of the first part of the object, relating to the rotor, is achieved according to the present invention by a rotor of the type named above that is characterized in that the spacing elements of the discs are designed and disposed such that via different rotational positions relative to one another of discs that are adjacent to one another in the disc stack, at least two different axial spacings, having different gap dimensions of the flow gap between the adjacent discs, are capable of being set.

The present invention advantageously enables the production of disc stacks made up of discs identical to one another, while nonetheless having at least two different disc spacings in the disc stack, the respective disc spacing here being a function only of the relative rotational position of the adjacent discs. Because only one design of the discs is required, the tool costs are advantageously kept low, which results in good cost efficiency in the production of disc stacks and rotors for centrifugal separators.

A first embodiment of the rotor provides that rotational positions at a distance from one another in the circumferential direction, in which the engagement contour and the corresponding contour are capable of being brought into engagement with one another, have a distance from one another in a uniform angular grid that has a grid angular distance, the grid angular distance corresponding to a whole-number fraction of 360°. Each configuration of a disc offset by the grid angular distance in the circumferential direction relative to an immediately adjacent disc then yields a change in the axial spacing of the two discs.

Alternatively, another embodiment of the rotor provides that the rotational positions at a distance from one another in the circumferential direction, in which the engagement contour and the corresponding contour can be brought into engagement with one another, lie in two angular grids superposed on one another and offset from one another by an offset angle in the circumferential direction, the two angular grids each having a uniform, agreeing grid angular distance, the grid angular distance corresponding to a whole-number fraction of 360°, and the offset angle being less than half the grid angular distance. In this embodiment of the rotor, there is the additional possibility of changing the axial distance between two immediately adjacent discs via a smaller angle offset by the above-named offset angle.

A further embodiment of the rotor provides that each disc has first and second spacing elements, and that the first and second spacing elements differ in their height and/or in their radial position on the disc. These spacing elements are easy to manufacture, and the axial disc spacing can easily be changed by placing two immediately adjacent discs onto the central shaft rotated relative to one another by the grid angular distance or by the offset angle.

In addition, it is preferably provided that the first and second spacing elements are formed by two different bumps or beads molded in or impressed in the discs, each forming a raised part on the one disc side and a recess on the other disc side. Such spacing elements can advantageously be produced, for example, by simple pressing or embossing.

Here it is additionally possible that the spacing elements configured at a distance from one another in the circumferential direction of the disc are each fashioned as an individual bump or as a radially running row, each made up of a plurality of bumps.

Preferably, it is further provided that the first and second spacing elements of each disc have an angular distance from one another in the circumferential direction, and that the first spacing elements of each disc have an angular distance from one another in the circumferential direction that is twice as large, and that the second spacing elements of each disc also have the angular distance from one another that is twice as large in the circumferential direction, and that the angular distance corresponds to the grid angular distance.

A further embodiment of the rotor provides that each disc has first and second spacing elements, and that the first and second spacing elements are formed by webs or nubs that are attached to or integrally formed on the discs and that form raised parts.

In a further embodiment in this regard, it is proposed that the webs or nubs that form the first spacing elements be situated on the upper side of the disc, and that the webs or nubs forming the second spacing elements be situated on the lower side of the disc, and that the webs or nubs forming the first spacing elements be offset in the circumferential direction of the disc relative to the webs or nubs forming the second spacing elements. Here as well, the axial disc spacing can easily be changed by placing two immediately adjacent discs onto the central shaft rotated by the grid angular distance, the upper-side and lower-side spacing elements of two immediately adjacent discs either contacting one another and bringing about a larger axial disc spacing, or not contacting one another and bringing about a smaller axial disc spacing.

Here, in addition, it is further provided that the first and second spacing elements of each disc have an angular distance from one another in the circumferential direction, and that the first spacing elements of each disc have an angular distance from one another that is twice as large in the circumferential direction, and that the second spacing elements of each disc also have the angular distance from one another that is twice as large in the circumferential direction, and that the angular distance corresponds to the grid angular distance.

An embodiment of the rotor alternative thereto provides that the webs or nubs forming the first spacing elements are situated on the upper side of the disc, and that the webs or nubs forming the second spacing elements are situated on the lower side of the disc, and that the webs or nubs forming the first spacing elements are positioned so as to congruently overlap with the webs or nubs forming the second spacing elements, and that the angular distance of the spacing elements at a distance from one another in the circumferential direction of the discs corresponds to twice the grid angular distance. In this embodiment of the rotor as well, the axial disc spacing can easily be changed by placement of two immediately adjacent discs onto the central shaft so as to be rotated by the grid angular distance or the offset angle.

In order to keep the manufacture of the discs simple, it is preferably provided that the webs or nubs situated on the upper side of the disc and forming the first spacing elements and the webs or nubs situated on the lower side of the disc and forming the second spacing elements are identical to one another.

Using the present invention, different rotors are easily producible. On the one hand, it is possible for all discs within the disc stack of a first rotor embodiment to have a first, smaller axial distance from one another, having a smaller gap dimension, and for all discs within the disc stack of a second rotor embodiment, having discs identical to those of the first rotor embodiment, to have a second, larger axial distance from one another, having a larger gap dimension.

Alternatively to this, it is possible for the discs within the disc stack of the rotor to have different axial spacings, in particular, to have a smaller axial distance from one another, having a smaller gap dimension, in a region of the rotor close to the inflow, and to have a larger axial distance from one another, having a larger gap dimension, in a region of the rotor remote from the inflow. In this way, in particular, a more uniform distribution of the flow of a volume of a fluid medium to be treated in the rotor to the multiplicity of flow gaps can be achieved.

In order to keep the production of the individual discs and of the disc stack, as well as of the central shaft of the rotor, practical with regard to their engagement contours and corresponding contours, it is proposed that the engagement contour and the corresponding contour be capable of being brought into engagement with one another in two to sixteen, in particular six to twelve, rotational positions at a distance from one another in the circumferential direction of the central shaft and of the discs.

As needed, the number of rotational positions in which the central shaft and the discs can be brought into engagement with one another can also be greater than the above-named numbers, the grid angular distance then becoming correspondingly smaller. This can be useful, for example, if more than two different axial disc spacings are to be capable of being set.

The discs of the rotor are preferably press-stamped parts made of sheet metal, or injection-molded parts made of plastic. Both types of discs can be comparatively simply and economically produced and provided with the necessary spacing elements, both preferably taking place in one working step.

Independent of the realization of the spacing elements, it is proposed that the engagement contour on the outer circumference of the shaft be formed by a number of n teeth that run in the longitudinal direction of the shaft and that protrude radially outward, and that the corresponding contour on the inner circumference of the discs be formed by a number of n or 2×n outward-pointing recesses that mate with the teeth.

Preferably, here the number n is between 2 and 8, preferably 3 to 6, so as not to complicate the production of the engagement contours and corresponding contours. The number n is also determined by the forces that are to be accommodated during operation of the rotor, acting in the circumferential direction of the rotor between the discs and the central shaft.

The solution of the second part of the object, relating to the centrifugal separator, is achieved according to the present invention by a centrifugal separator that is characterized in that it has a rotor according to the above description.

In a preferred use, the centrifugal separator according to the present invention is an oil mist separator for the crankcase ventilation gas of an internal combustion engine, and can advantageously be used for the effective separation of oil mist and oil droplets from the crankcase ventilation gas of the internal combustion engine. In a rotor of such a centrifugal separator, the discs have a very small distance from one another; in practice, this is, for example, between approximately 0.3 and 0.5 mm. For this application, the discs can then, for example, be realized such that, in a first rotational position relative to one another, they form a first spacing between them of 0.3 mm, and in a second rotational position relative to one another they form a second spacing between them of 0.5 mm. The discs and their spacing elements can also be realized such that, in a third rotational position relative to one another, they form a third spacing between them, e.g., 0.4 mm. In this way, during the production of the rotor different gap dimensions that meet the needs of the situation can easily be set between the discs of the rotor, which are identical to one another.

BRIEF DESCRIPTION OF THE DRAWINGS

In the following, exemplary embodiments of the present invention are explained on the basis of a drawing.

In the following description of the Figures, identical parts in the various Figures of the drawing are always provided with the same reference characters, so that all reference characters do not have to be explained again for each Figure of the drawing.

DETAILED DESCRIPTION OF THE PREFERRED EMBODIMENTS

Figure 1:
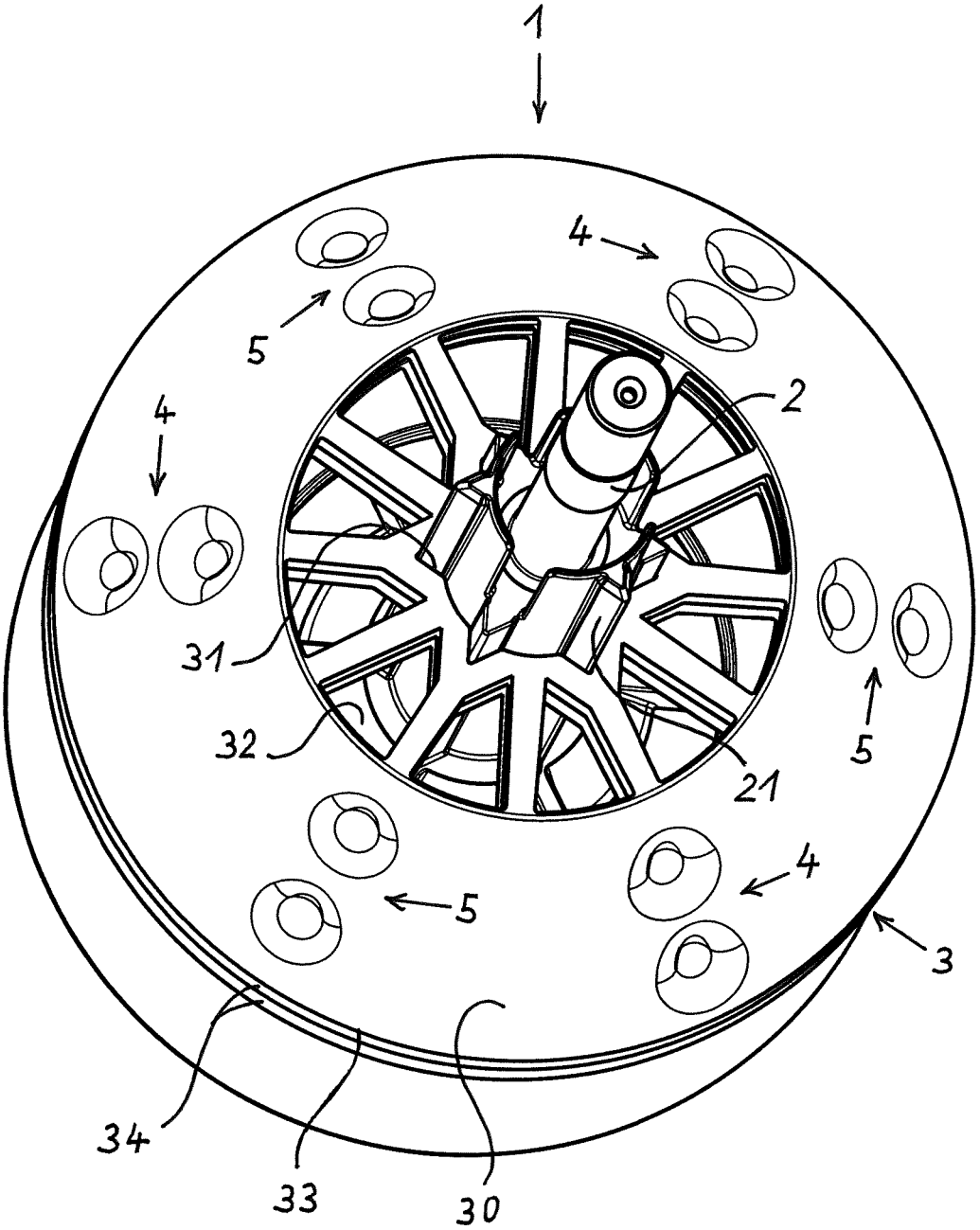
FIG. 1 shows a rotor of a centrifugal separator in a first embodiment, in an oblique view from above.
Figure 3:
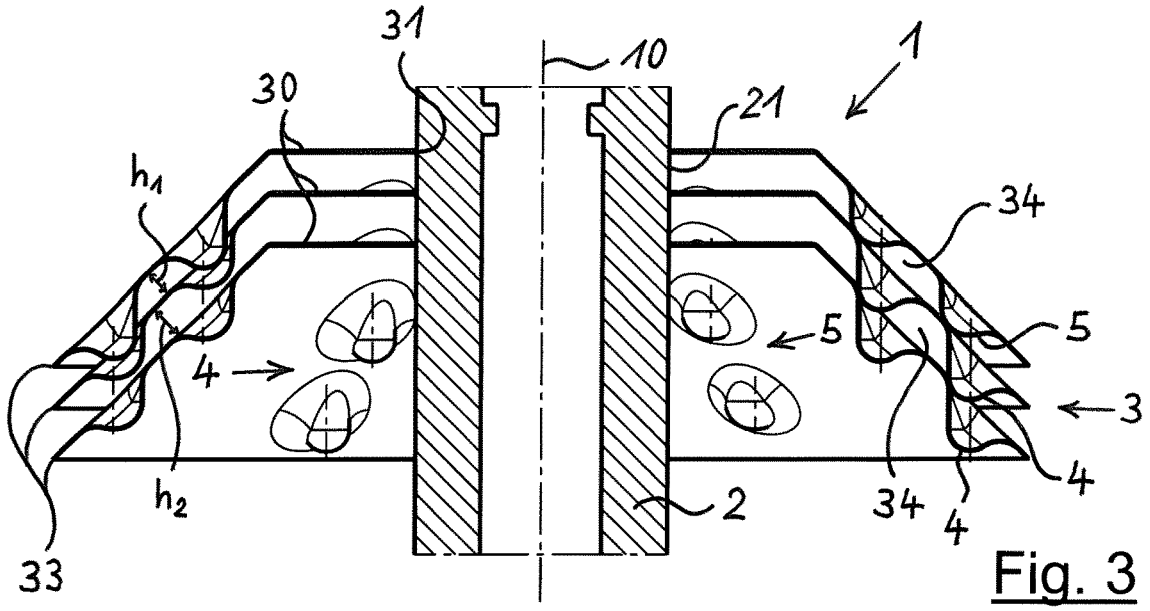
FIG. 3 shows the rotor of FIG. 2 in longitudinal section along sectional line III-III in FIG. 2.
Figure 2:
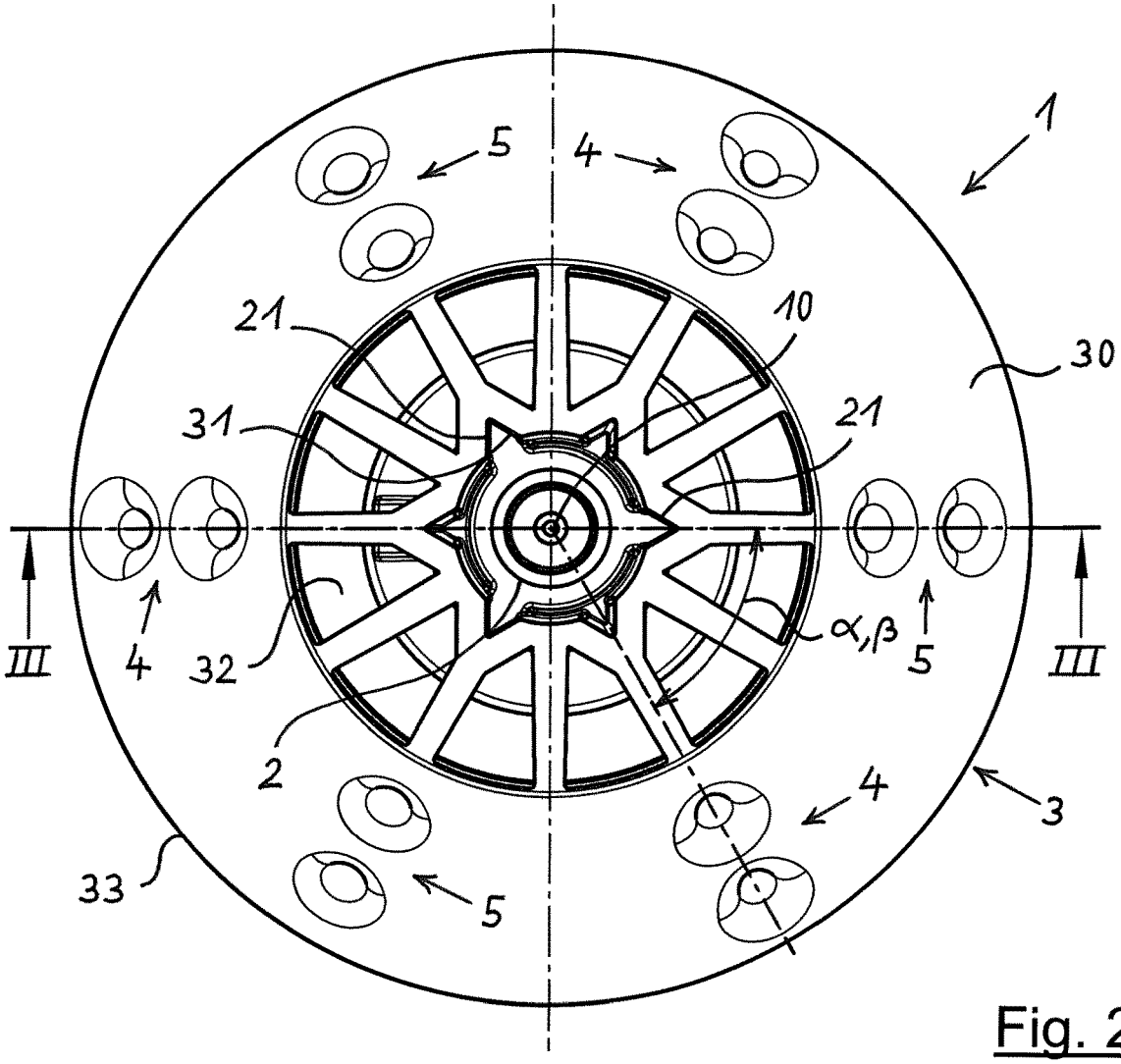
FIG. 2 shows the rotor of FIG. 1, in a plan view.
Figure 4:
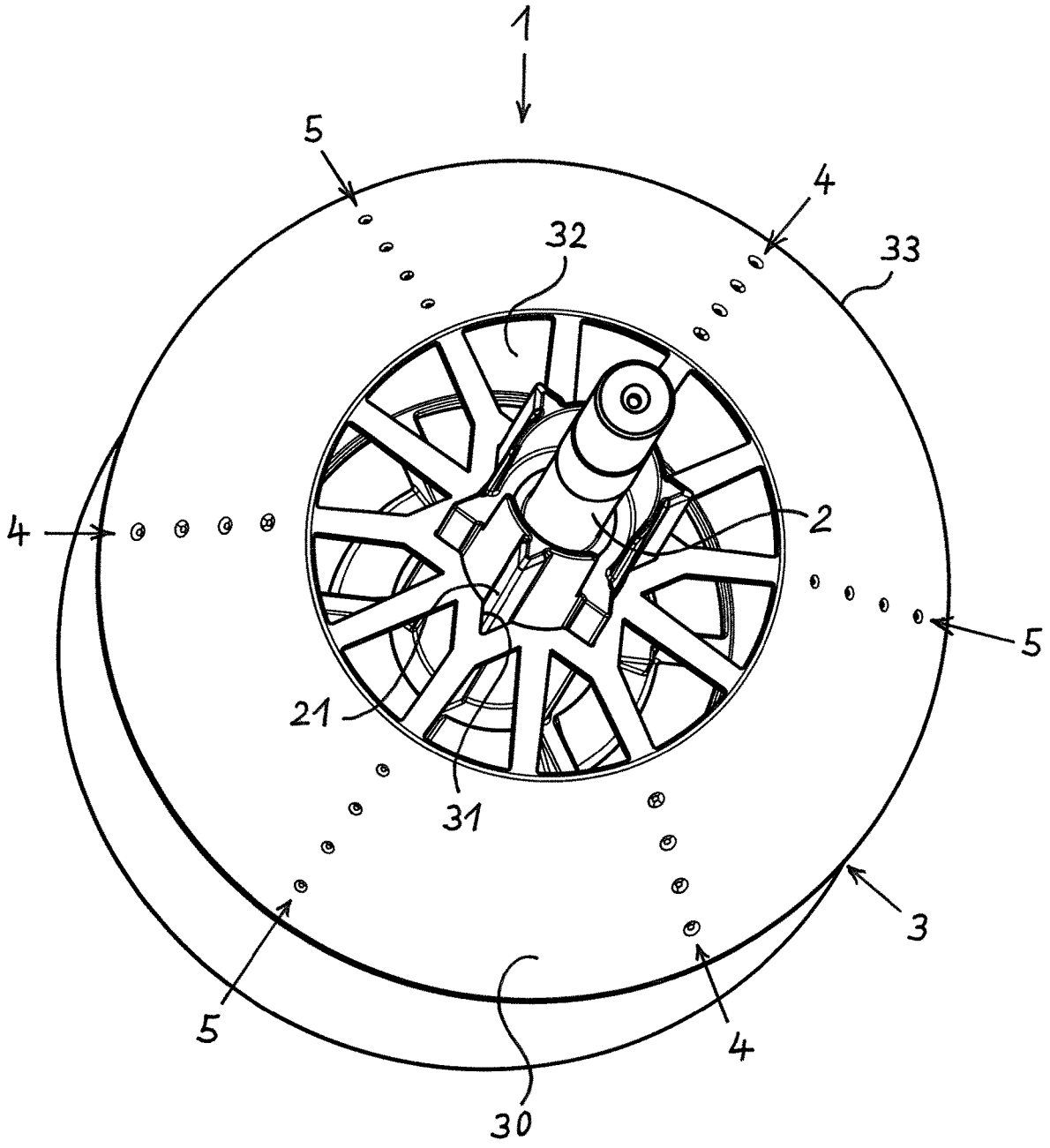
FIG. 4 shows the rotor in a second embodiment, in an oblique view from above.
Figure 6:
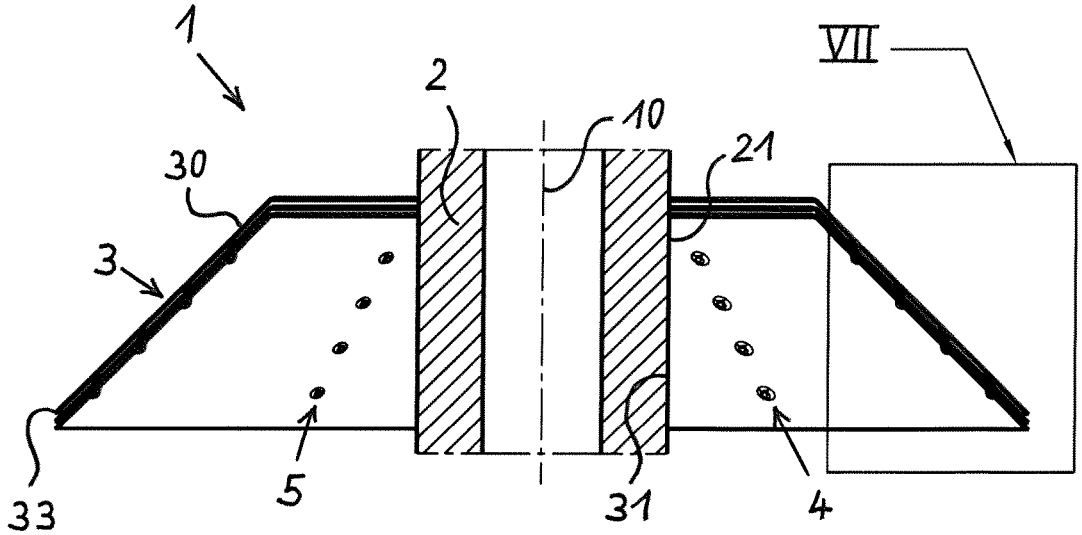
FIG. 6 shows the rotor of FIG. 5 in longitudinal section along sectional line VI-VI in FIG. 5.
Figure 5:
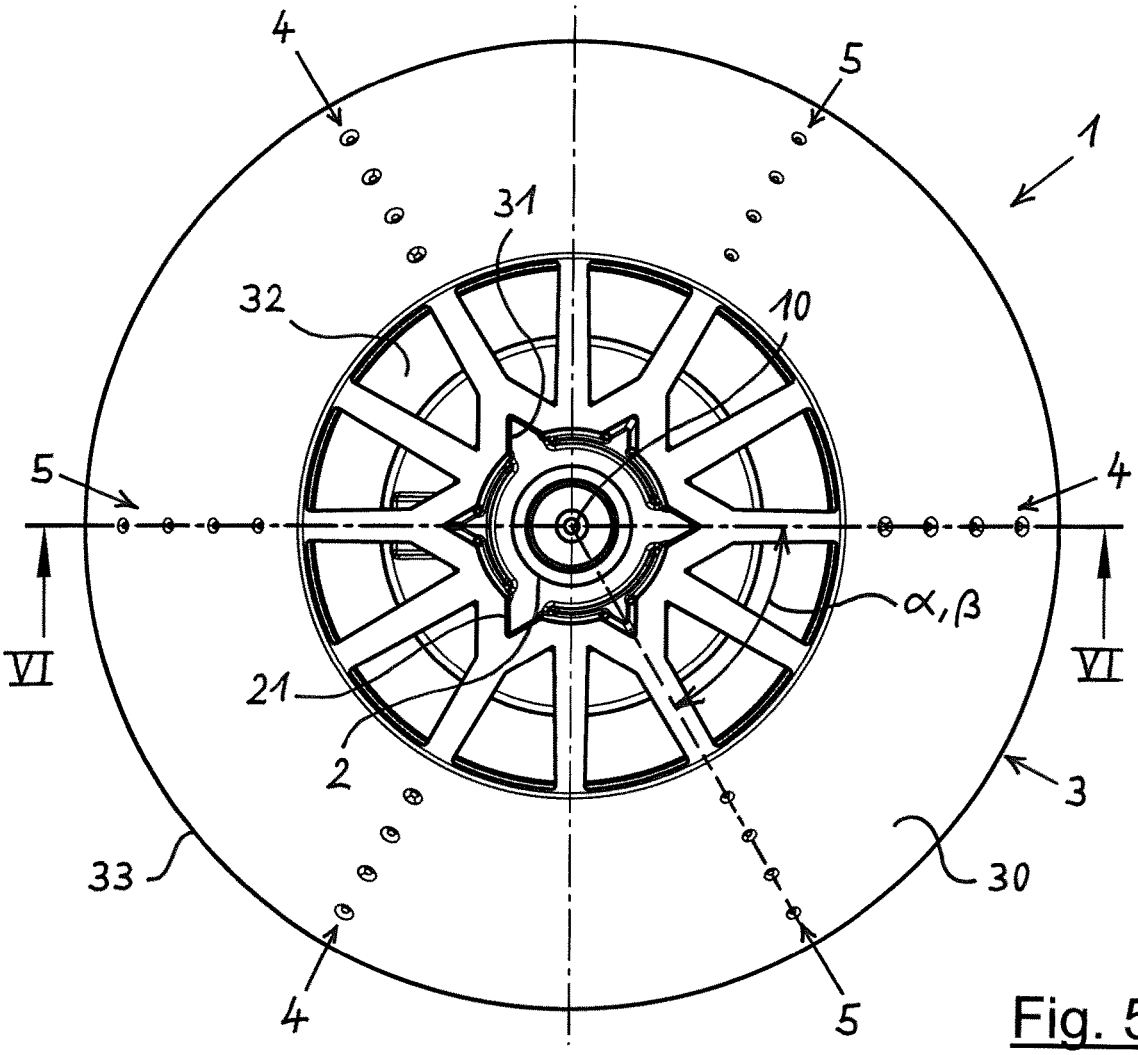
FIG. 5 shows the rotor of FIG. 4 in a plan view.

FIGS. 1 through 3 of the drawing show a rotor 1 of a centrifugal separator (otherwise not shown), in a first embodiment. Rotor 1 has a central shaft 2 on which a disc stack 3 made up of a plurality of identical discs 30 is situated. Discs 30 here each have the known shape of a frustum-shaped jacket, and may be made of sheet metal or plastic. For ease of representation, in FIG. 1 only a few discs 30 are shown; in practice, a disc stack 3 will have up to 100 or more discs 30.

Shaft 2 has on its outer circumference an engagement contour 21 for rotationally fixed, axially slidable engagement with a corresponding contour 31 on the inner circumference of disc 30 of disc stack 3, engagement contour 21 here having the shape of a six-pointed star. Engagement contour 21 and corresponding contour 31 can be brought into engagement with one another in a plurality of relative rotational positions that are at a grid angular distance α, here 60°, from one another in the circumferential direction.

Radially outward from corresponding contour 31, distributed in the circumferential direction are a plurality of flow openings 32 in discs 30, through which, during operation of rotor 1, a fluid medium to be cleaned, such as crankcase ventilation gas of an internal combustion engine, flows in axially, and from where the fluid medium then flows outward in the radial direction into flow gaps 34 between the adjacent discs 30. A reversed direction of flow of the fluid medium during operation of rotor 1 is also possible.

The separation mechanism of rotors 1 of the type here discussed in centrifugal separators is known, and therefore need not be further explained here.

Discs 30 have spacing elements 4, 5, that hold each two adjacent discs 30 in disc stack 3 at a distance from one another, forming the intermediate flow gap 34 having a specifiable gap dimension.

The distinguishing feature of discs 30 of disc stack 3 is that each disc 30 has two first and second spacing elements 4, 5, at different distances from one another in the circumferential direction of discs 30 such that via different rotational positions of adjacent discs 30 relative to one another in disc stack 3, two different spacings between the adjacent discs 30 can be produced, having different gap dimensions h1, h2 of flow gap 34, as is shown in particular in FIG. 3.

The two different first and second spacing elements 4, 5 are here formed by two different bumps that are molded or impressed into discs 30, respectively forming a raised part on the one side of the disc, here the lower side, and forming a recess on the other side of the disc, here the upper side, and situated one after the other in pairs in the radial direction.

Seen in the circumferential direction of discs 30, first spacing elements 4 and second spacing elements 5 are here separated from one another by an angular distance β of 60°. This angular distance β is thus identical to grid angular distance α of engagement and corresponding contours 21, 31.

The bumps forming first and second spacing elements 4, 5 here differ both in their height and in their radial position on disc 30. The bumps forming first spacing elements 4 have a larger axial depth, and are situated somewhat further outward, seen in the radial direction. The bumps forming second spacing elements 5 have a smaller axial depth, and, seen in the radial direction, are situated somewhat further inward than the bumps forming first spacing elements 4.

If, as in the case of the two upper immediately adjacent discs 30 in FIG. 3, these discs are configured in a relative rotational position in disc stack 3 in which first spacing elements 4 of the one, lower disc 30 are situated so as to congruently overlap with second spacing elements 5 of the other, upper disc 30, then the two adjacent discs 30 have a smaller spacing, having a gap dimension h1 of intermediate flow gap 34.

If, as in the case of the two lower immediately adjacent discs 30 in FIG. 3, these discs are configured in a relative rotational position in disc stack 3 in which the first spacing elements 4 of the one disc 30 are situated so as to congruently overlap with the first spacing elements 4 of the other disc 30, then the two adjacent discs 30 have a larger spacing, having a gap dimension h2 of intermediate flow gap 34.

In order to change the gap dimension h between two adjacent discs 30, a placement on the shaft of the one disc 30 rotated by spacer element angular distance β is sufficient, spacing element angular distance β here being identical to grid angular distance α.

In FIG. 3, the distances of discs 30 from one another are shown exaggeratedly large, for ease of visibility. In reality, the gap dimension h between two adjacent discs 30 is often only a few tenths of a millimeter.

Thus, the identical discs 30 within disc stack 3 of rotor 1 can have different distances from one another, having different gap dimensions h1, h2 of flow gap 34. This can advantageously be used, for example, in a region of rotor 1 close to the inflow to configure discs 30 with a smaller axial distance from one another, having a smaller gap dimension h1, and in a region of rotor 1 remote from the inflow to configure discs 30 with a greater axial distance from one another, having a larger gap dimension h2, in order to make the flow through disc stack 3 uniform.

It is also possible for all discs 30 within disc stack 3 of a first rotor embodiment to have a first, smaller axial distance from one another, having a smaller gap dimension h1, and, inside disc stack 3 of a second rotor embodiment having discs identical to those of the first rotor embodiment, for all discs 30 to have a second, greater axial distance from one another, having a larger gap dimension h2.

FIGS. 4 through 7 show rotor 1 in a second embodiment. Differing from the first embodiment of rotor 1 is that here the bumps forming first and second spacing elements 4, 5 are smaller, and are realized in the form of radially running rows of bumps, each row having four bumps. In this way, more points of contact are formed between the respectively adjacent discs 30 in disc stack 3, which promotes the dimensional stability of the stack during operation at high rotational speeds.

The bumps forming first and second spacing elements 4, 5 differ here as well in their height and in their radial position on disc 30. The bumps forming first spacing elements 4 have a larger axial depth, and, seen in the radial direction, are situated somewhat further outward. The bumps forming second spacing elements 5 have a smaller axial depth and, seen in the radial direction, are situated somewhat further inward.

Seen in the circumferential direction of discs 30, here as well there is an angular distance β of 60° between first spacing element 4 and second spacing element 5. This angular distance β is thus identical to grid angular distance α of engagement and corresponding contours 21, 31.

Figure 7:
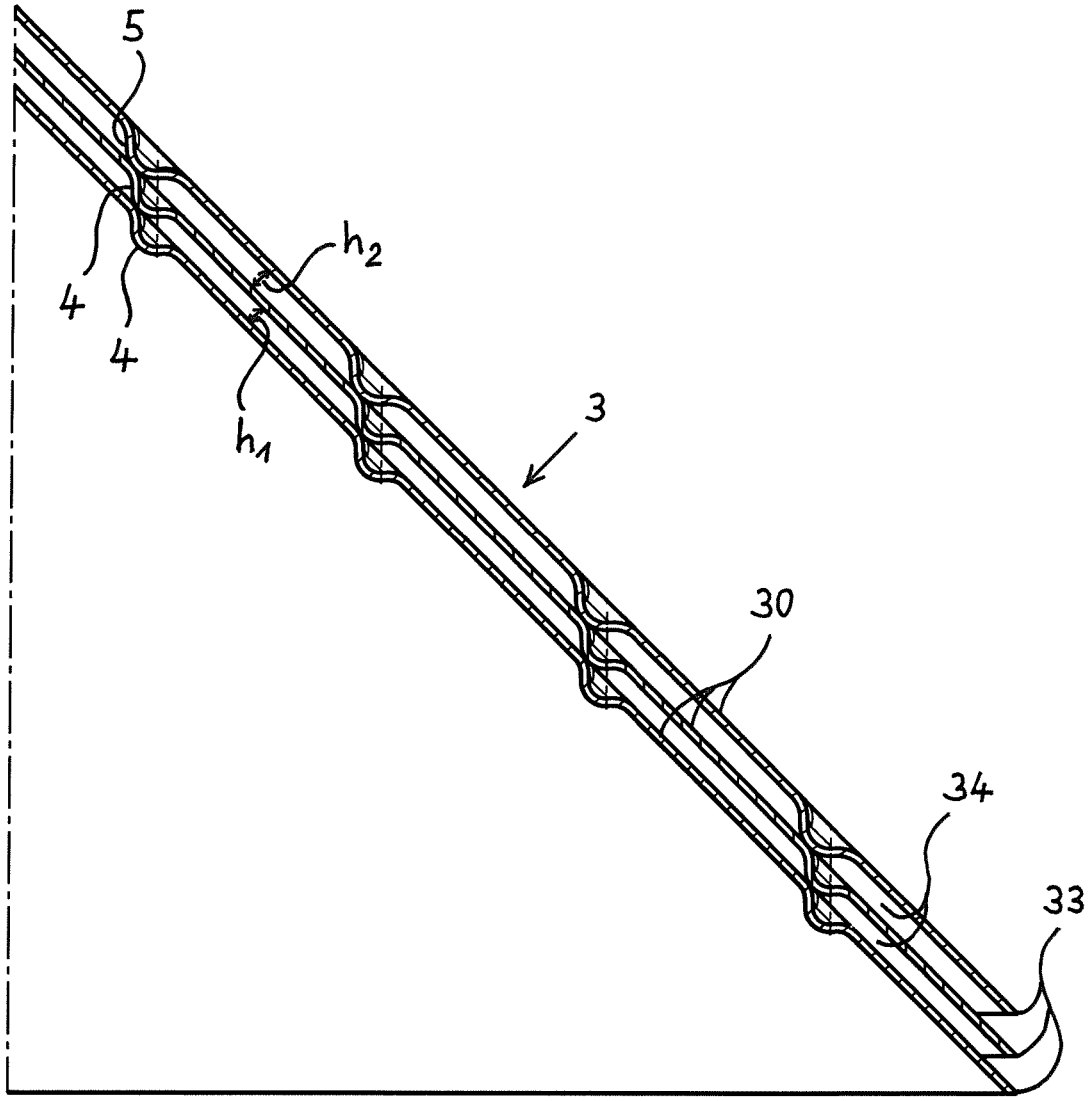
FIG. 7 shows detail VII enclosed by a box in FIG. 6, in an enlarged representation.
Figure 8:
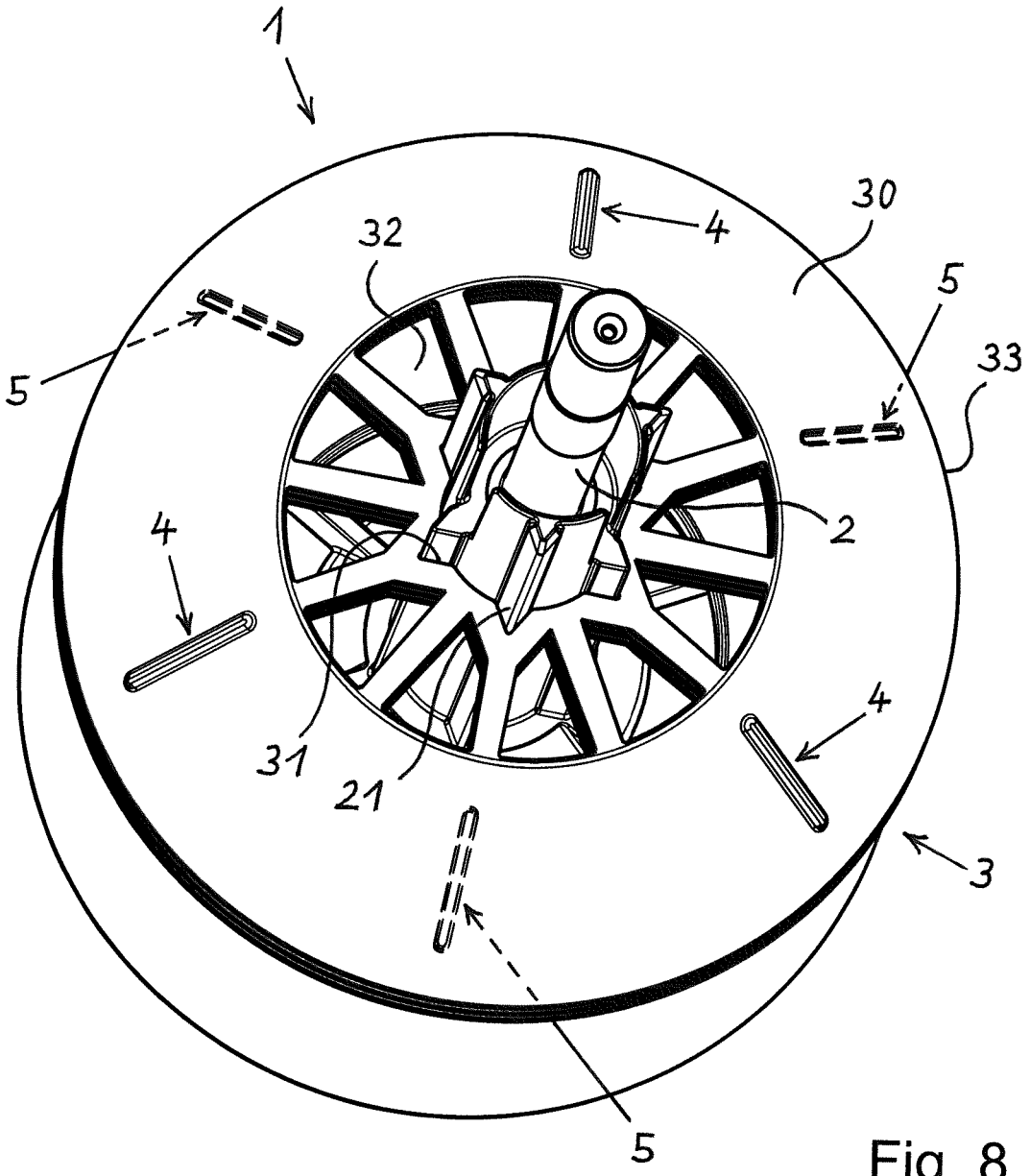
FIG. 8 shows the rotor in a third embodiment, in an oblique view from above.

If, as in the case of the two lower immediately adjacent discs 30 in FIG. 7, these discs are configured in a relative rotational position in disc stack 3 in which first spacing elements 4 of the one disc 30 are situated so as to congruently overlap with first spacing elements 4 of the other disc 30, then the two adjacent discs 30 have a smaller spacing, having a gap dimension h1 of intermediate flow gap 34.

If here, as in the case of the two upper immediately adjacent discs 30 in FIG. 7, these discs are configured in a relative rotational position in disc stack 3 in which first spacing elements 4 of the one, here lower, disc 30 are situated so as to congruently overlap with second spacing elements 5 of the other, here upper, disc 30, then the two adjacent discs 30 have a larger spacing, having a gap dimension h2 of intermediate flow gap 34.

In its further features and properties, rotor 1 according to FIGS. 4 through 7 agrees with the exemplary embodiment according to FIGS. 1 through 3, to the description of which reference is therefore made.

FIGS. 8 through 11 show rotor 1 in a third embodiment. Differing from the previously described embodiments of rotor 1 is that here first and second spacing elements 4, 5 are formed by webs that are attached to or integrally formed on discs 30 and that form raised parts. The spacing elements 4, 5 formed by the webs here run in a straight line in the radial direction. Alternatively, spacing elements 4, 5 may also run in a curve.

The webs forming first spacing elements 4, here three pieces, are situated on the upper side of disc 30, and the webs forming second spacing elements 5, also three pieces, are situated on the lower side of disc 30. Moreover, here the webs forming first spacing elements 4 are offset relative to the webs or nubs forming second spacing elements 5 in the circumferential direction of disc 30. The angular distance β of the three webs, forming first spacing elements 4, to one another is here 120° in each case. The angular distance β of the three webs forming second spacing elements 5 is also 120° here. The angular distance in each case between a first spacing element 4 and a second spacing element 5 inside disc 30 is 60°. This angle of 60° corresponds to the grid angular distance α of the various rotational positions of disc 30 relative to central shaft 10 in which the two can be brought into engagement with one another via engagement contour 21 and corresponding contour 31.

Figure 10:
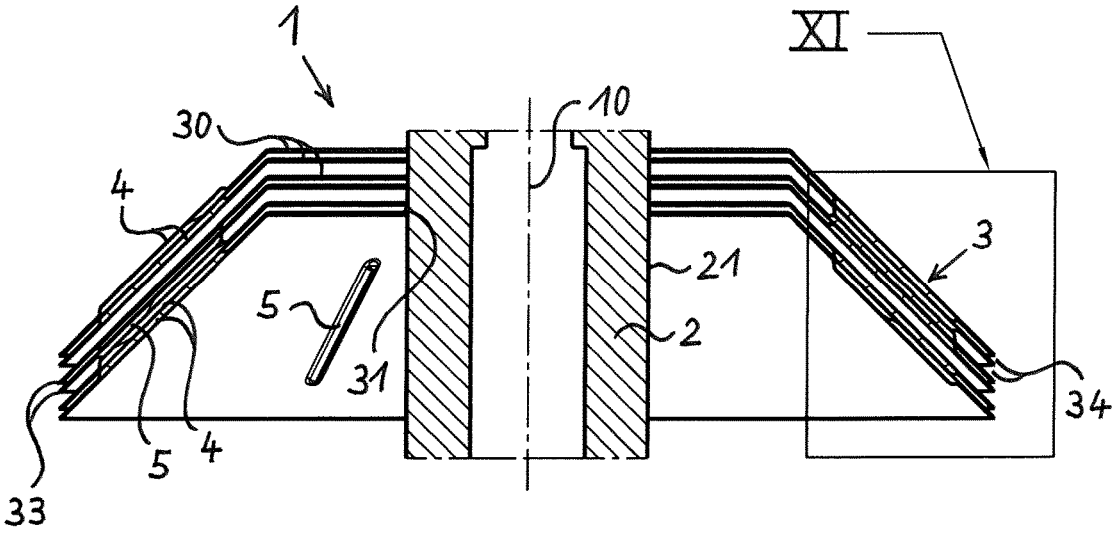
FIG. 10 shows the rotor of FIG. 9 in longitudinal section along sectional line X-X in FIG. 9.
Figure 9:
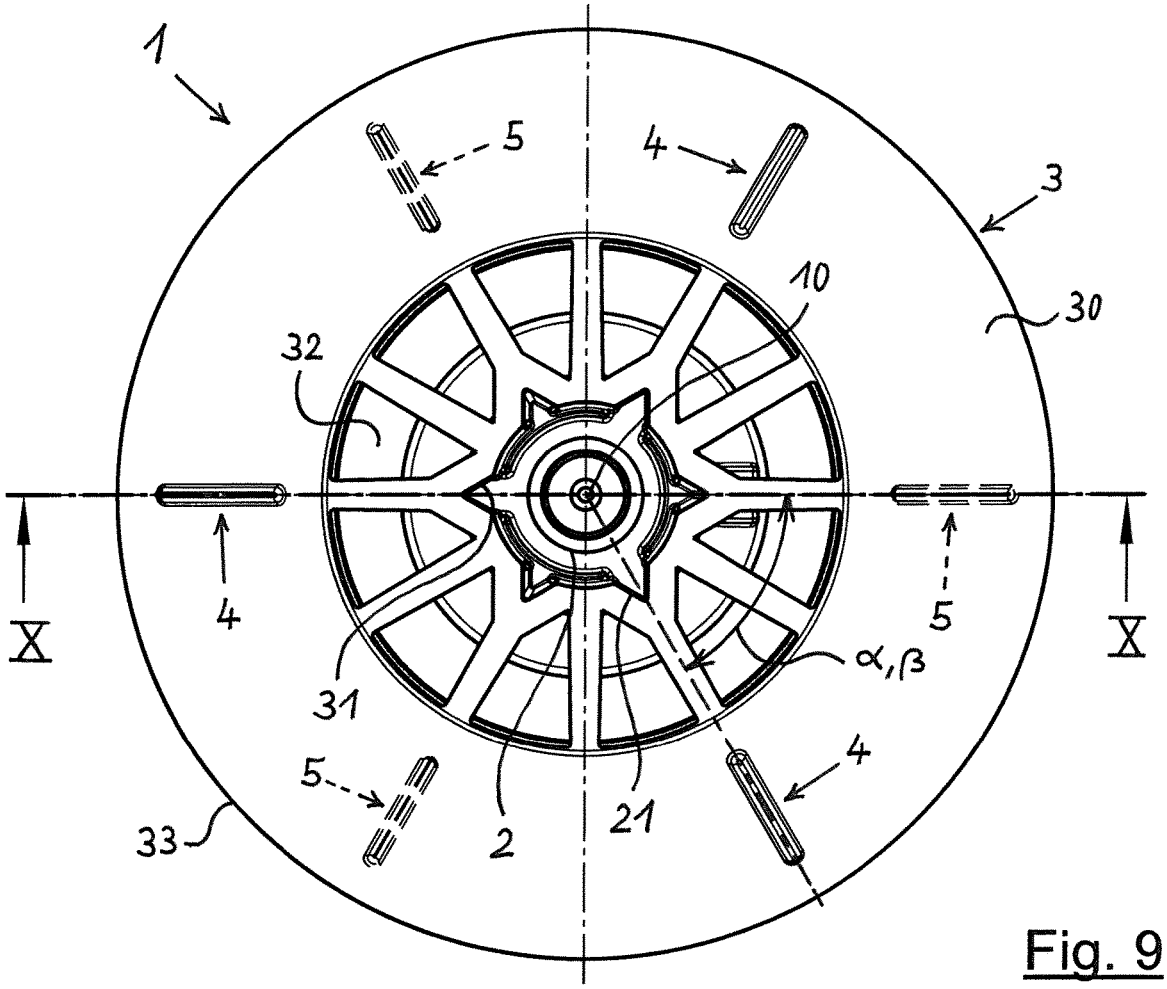
FIG. 9 shows the rotor of FIG. 8 in a plan view.
Figure 11:
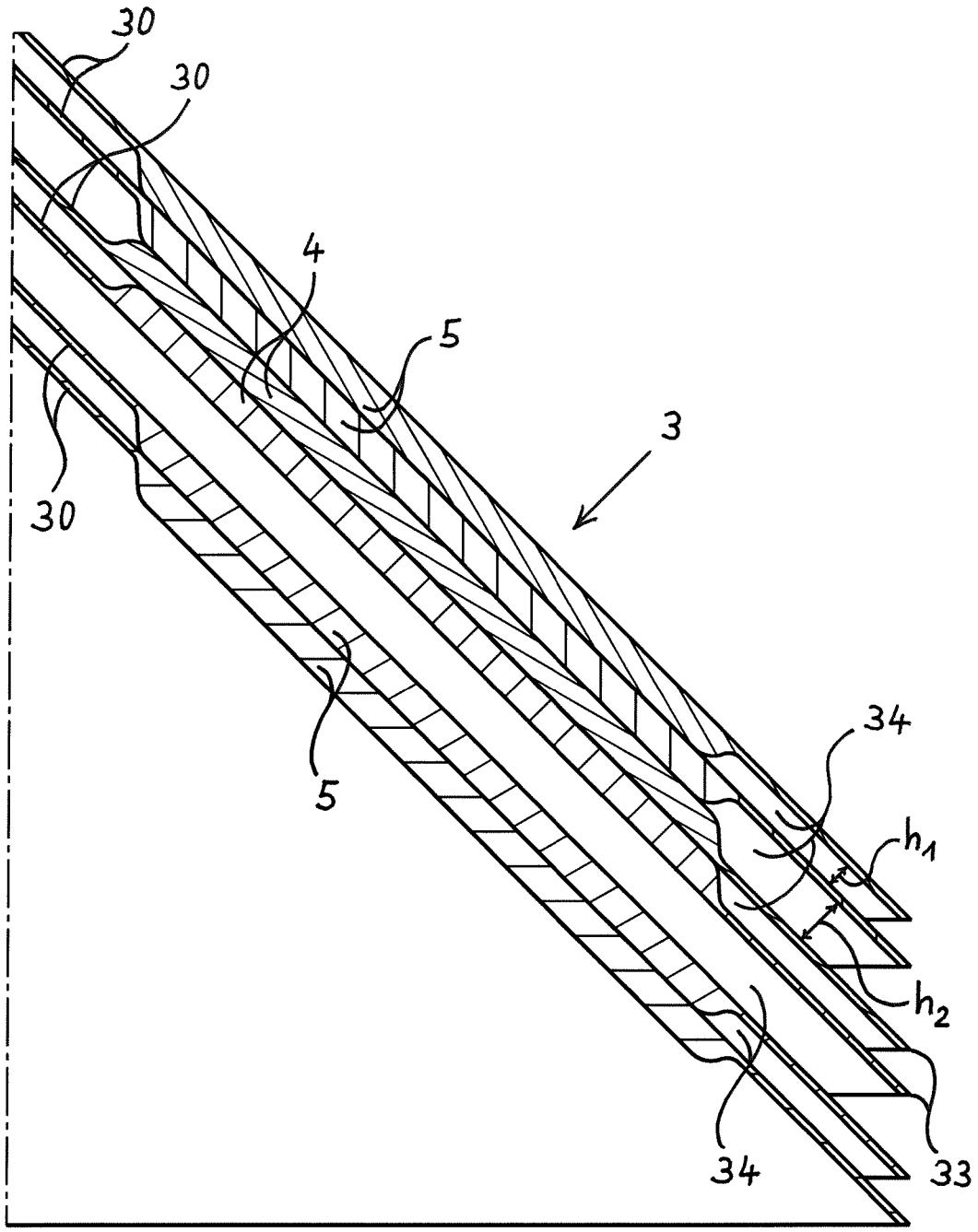
FIG. 11 shows detail XI enclosed by a box in FIG. 10, in an enlarged representation.
Figure 12:
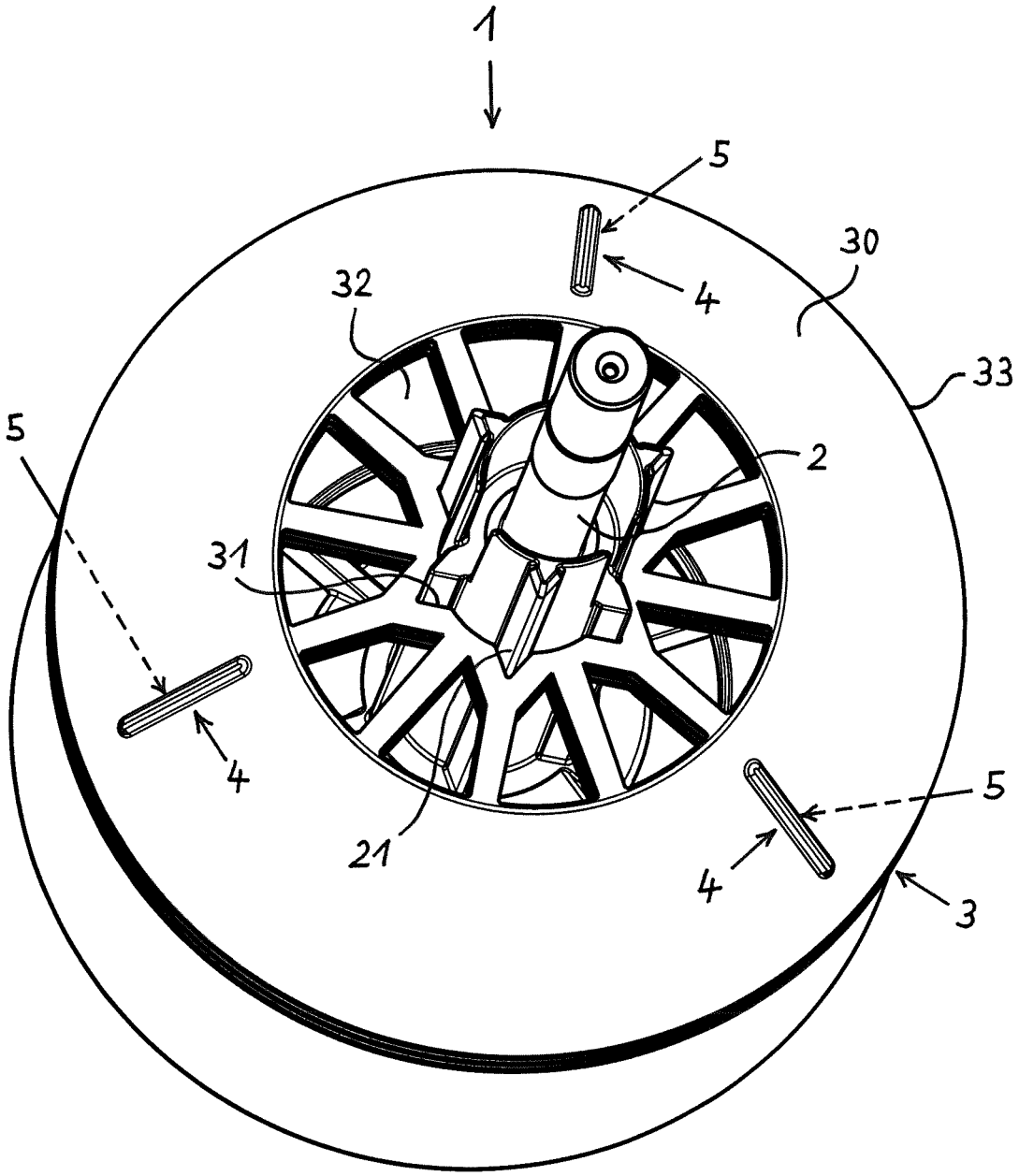
FIG. 12 shows the rotor in a fourth embodiment, in an oblique view from above.

If, as shown in FIG. 10 and shown in an enlarged view in FIG. 11, the two uppermost immediately adjacent discs 30 are configured in a relative rotational position in disc stack 3 in which second spacing elements 5 of the one, upper disc 30 are situated so as to congruently overlap with second spacing elements 5 of the other, lower disc 30, then these two adjacent discs 30 have a smaller spacing, having a gap dimension h1 of intermediate flow gap 34. Here, gap dimension h1 corresponds to the height of the individual spacing elements 4, 5 formed by the webs, which are identical to one another.

If, as shown in FIG. 10 and shown in an enlarged view in FIG. 11, second and third discs 30, seen from above, are configured in a relative rotational position in disc stack 3 in which the first spacing elements 4 of the first, here lower, discs 30 are situated so as to congruently overlap with second spacing elements 5 of the other, here upper, disc 30, then the two adjacent discs 30 have a greater spacing, having a gap dimension h2 of intermediate flow gap 34. Here, gap dimension h2 corresponds to the summed height of spacing elements 4 and 5, lying one on the other and formed by the webs.

In its further features and properties, rotor 1 according to FIGS. 8 through 11 agrees with the exemplary embodiment according to FIGS. 1 through 3, to the description of which reference is therefore made.

FIGS. 12 through 15 show rotor 1 in a fourth embodiment. Agreeing with the above-described exemplary embodiment of rotor 1 according to FIGS. 8 through 11, here as well first and second spacing elements 4, 5 are formed by webs that are attached to or integrally formed on discs 30 and that form raised parts.

The webs that form first spacing elements 4, here three pieces, are situated on the upper side of disc 30, and the webs, also three pieces, forming second spacing elements 5 are situated on the lower side of disc 30. Differing from the exemplary embodiment described above of rotor 1 according to FIGS. 8 through 11, here the upper-side webs forming first spacing elements 4 are situated so as to congruently overlap with the lower-side webs forming second spacing elements 5. The angular distance β of the three webs forming first spacing elements 4 from one another is here 120° in each case. The angular distance β of the three webs forming second spacing elements 5 is likewise 120° in each case here. The angular distance β between each two spacing elements 4, 5 thus here corresponds to twice the grid angular distance α of the various relative rotational positions of disc 30 to central shaft 10 in which the two can be brought into engagement with one another via engagement contour 21 and corresponding contour 31.

Figure 14:
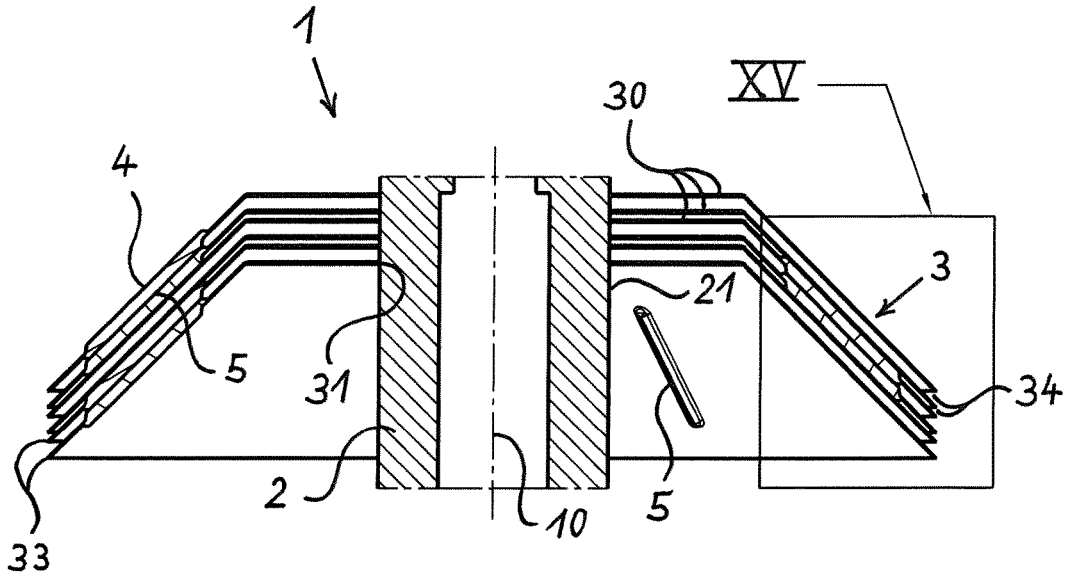
FIG. 14 shows the rotor of FIG. 13 in longitudinal section along sectional line XIV-XIV in FIG. 13.
Figure 13:
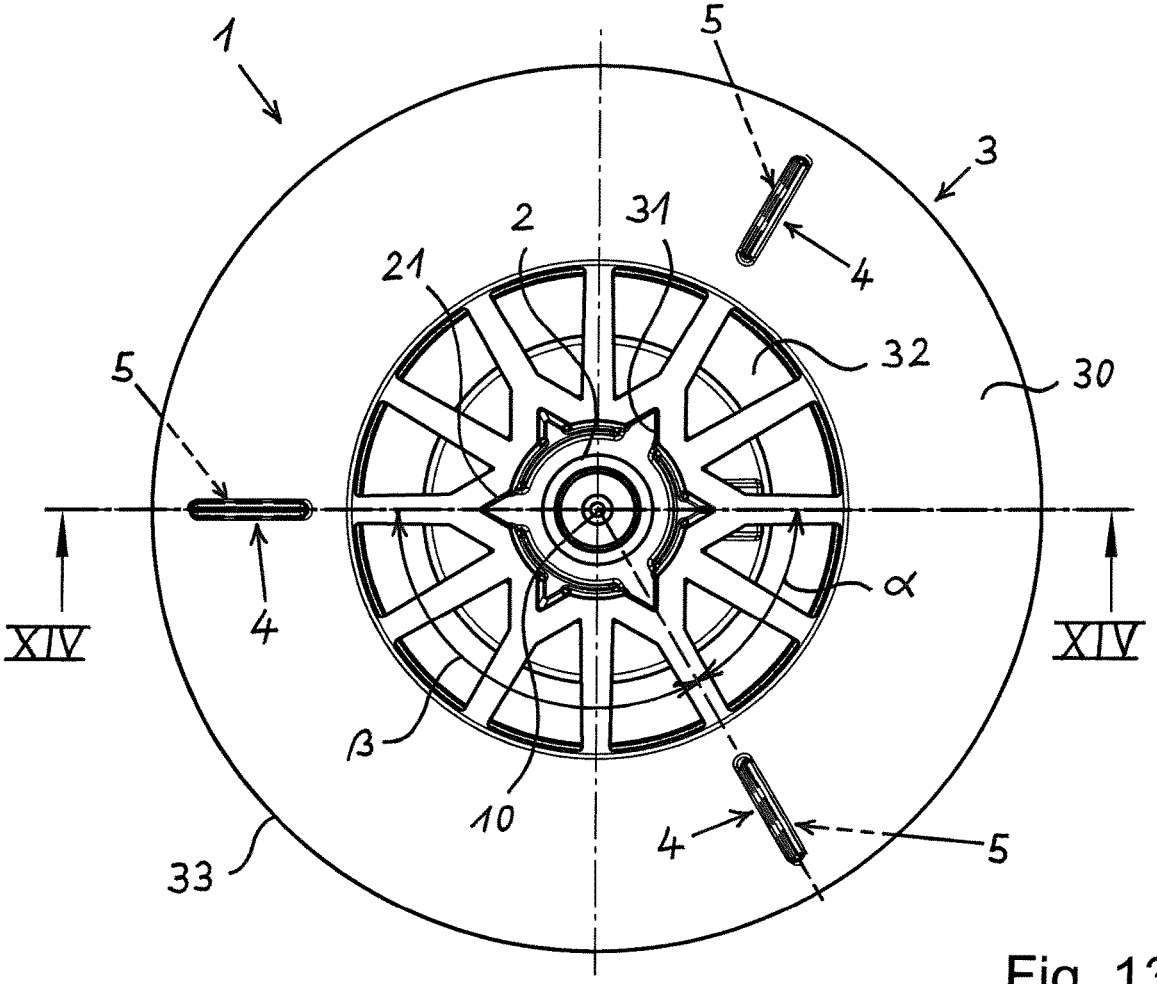
FIG. 13 shows the rotor of FIG. 12, in a plan view.
Figure 15:
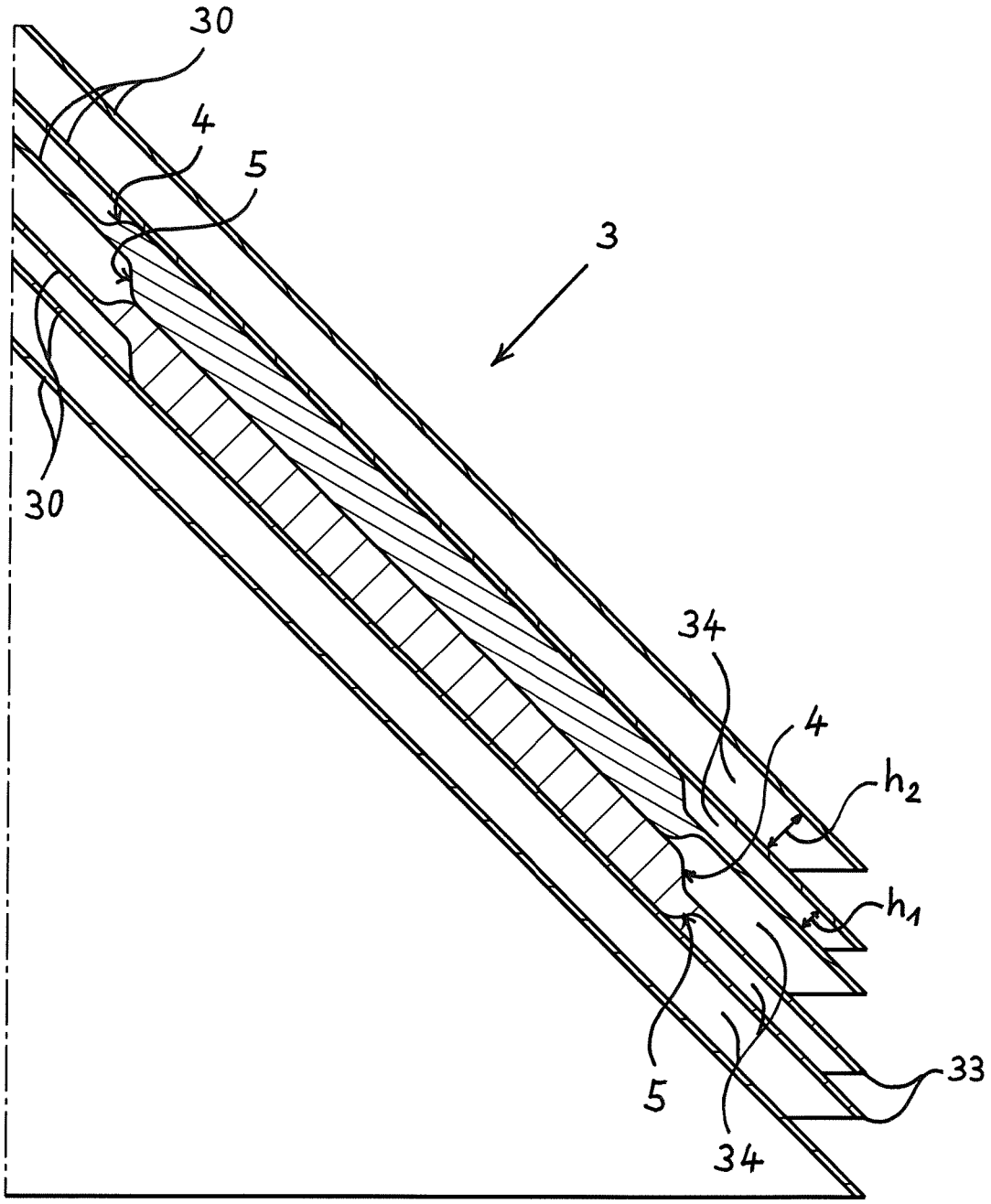
FIG. 15 shows detail XV enclosed by a box in FIG. 14, in an enlarged representation.
Figure 16:
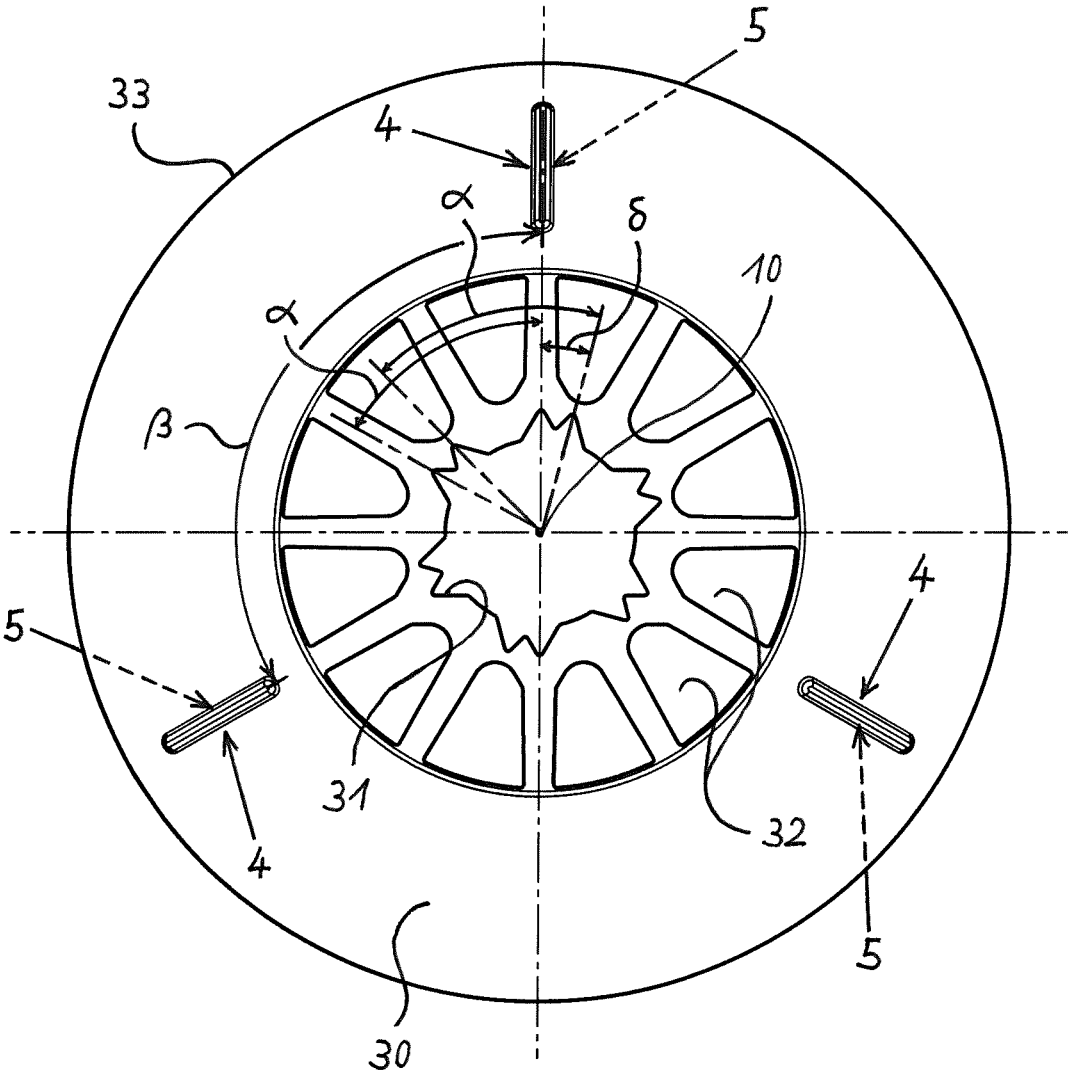
FIG. 16 shows a single disc of a rotor in a further embodiment, in a plan view.

If, as shown in FIG. 14 and in an enlarged view in FIG. 15 for the example of second and third disc 30 seen from above, the two discs 30 are configured in a rotational position relative to one another in disc stack 3 in which first spacing elements 4 of the one, upper disc 30 are not situated so as to congruently overlap with second spacing elements 5 of the other, lower disc 30, but rather are rotated relative to one another by grid angular distance α=60°, then these two adjacent discs 30 have a smaller axial spacing having a gap dimension h1 of intermediate flow gap 34. Here, gap dimension h1 corresponds to the height of the individual spacing elements 4, 5 formed by the webs, which here are identical to one another.

If, as shown in FIG. 10 and shown in an enlarged view in FIG. 11 for the example of third and fourth disc 30 seen from above, the two discs 30 are configured in a rotational position relative to one another in disc stack 3 in which first spacing elements 4 of the one, here lower, disc 30 are situated so as to congruently overlap with second spacing elements 5 of the other, here upper, disc 30, then the two adjacent discs 30 have a larger axial spacing, having a gap dimension h2 of intermediate flow gap 34. Here, gap dimension h2 corresponds to the summed height of the spacing elements 4 and 5, lying one on the other and formed by the webs.

In its further features and properties, rotor 1 according to FIGS. 12 through 15 agrees with the exemplary embodiments according to FIGS. 8 through 11, to the description of which reference is therefore made.

FIGS. 16 through 20 show discs 30 and rotor 1 in a further embodiment. Agreeing with the above-described exemplary embodiment of rotor 1 according to FIGS. 12 through 15, here as well first and second spacing elements 4, 5 are formed by webs attached to or integrally formed on discs 30 and forming raised parts.

The webs, here three pieces, forming first spacing elements 4 are situated on the upper side of disc 30, and the webs forming second spacing elements 5, likewise three pieces, are situated on the lower side of disc 30. Here as well, the upper-side webs forming first spacing elements 4 are configured so as to congruently overlap with the lower-side webs forming second spacing elements 5. The angular distance β of the three webs forming first spacing elements 4 from one another is here in each case 120°. The angular distance β of the three webs forming second spacing elements 5 is of equal size, here also in each case 120°.

Differing from the above-described exemplary embodiments, in the example according to FIGS. 16 through 24 the corresponding contour 31 on the inner circumference of discs 30 is changed. Here, for the corresponding contour 31 two angular grids are provided that are superposed on one another and are offset relative to one another in the circumferential direction by an offset angle δ. Here, the two angular grids each have a uniform, agreeing grid angular distance α, here 60°. Grid angular distance α can also have a different value; however, it always corresponds to a whole-number fraction of 360°. Offset angle δ is less than half the grid angular distance α; here, offset angle δ is 15°.

In this way, it is achieved that the rotational positions at a distance from one another in the circumferential direction in which engagement contour 21 and corresponding contour 31 can be brought into engagement with one another are situated in two superposed angular grids that are offset relative to one another in the circumferential direction by the offset angle δ. In comparison with the above-described exemplary embodiments, here there thus results twice the number of relative rotational positions between central shaft 2 and, in each case, a disc 30, in which its engagement contour 21 and corresponding contour 31 can be brought into engagement with each other.

Thus, spacing elements 4, 5 of two discs 30 adjacent to one another in disc stack 3 can either be positioned so as to congruently overlap with one another, in order to produce an axial spacing of the two discs 30 having a larger gap dimension h2 between them, or can be positioned at two different distances from one another in the circumferential direction, in each case not congruently overlapping with each other, in order to produce an axial spacing of the two discs 30 with a smaller gap dimension h1 between them.

When the small gap dimension h1 is selected, the spacing elements 4, 5 adjacent to one another in the circumferential direction of two discs 30 axially adjacent to one another in disc stack 3 differ in their position only by offset angle δ, i.e., by 15° in the depicted example. Alternatively, the spacing elements 4, 5, adjacent in the circumferential direction, of two axially adjacent discs 30 in disc stack 3 can also be positioned at a distance from one another of the grid angular distance α, here 60°, or of an angle α-δ, i.e. here 45°. Thus, here a high degree of flexibility is achieved in the configuration of disc stack 3.

Figure 18:
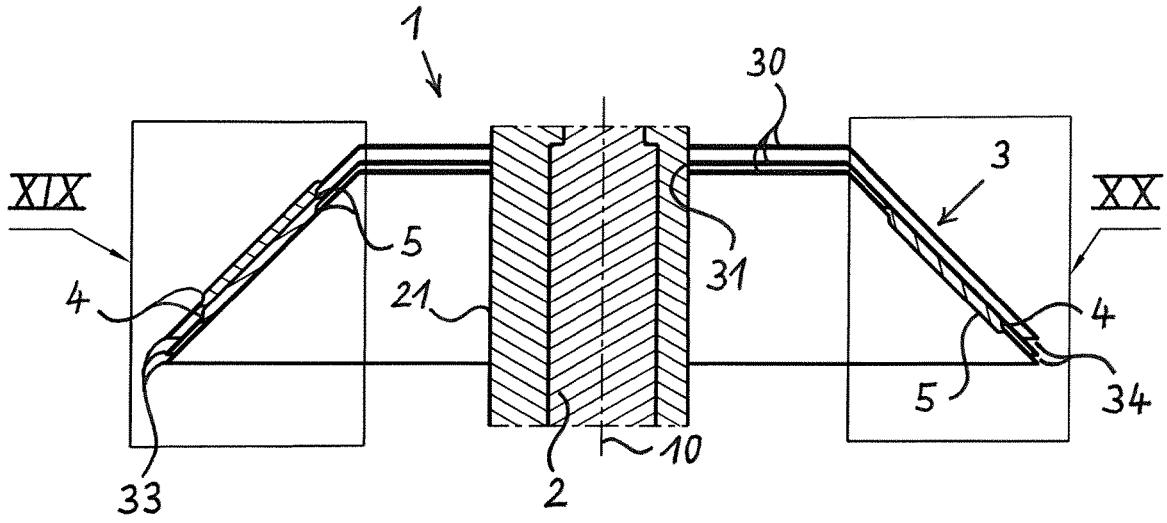
FIG. 18 shows the rotor of FIG. 17 in section along sectional line XVIII-XVIII in FIG. 17.
Figure 17:
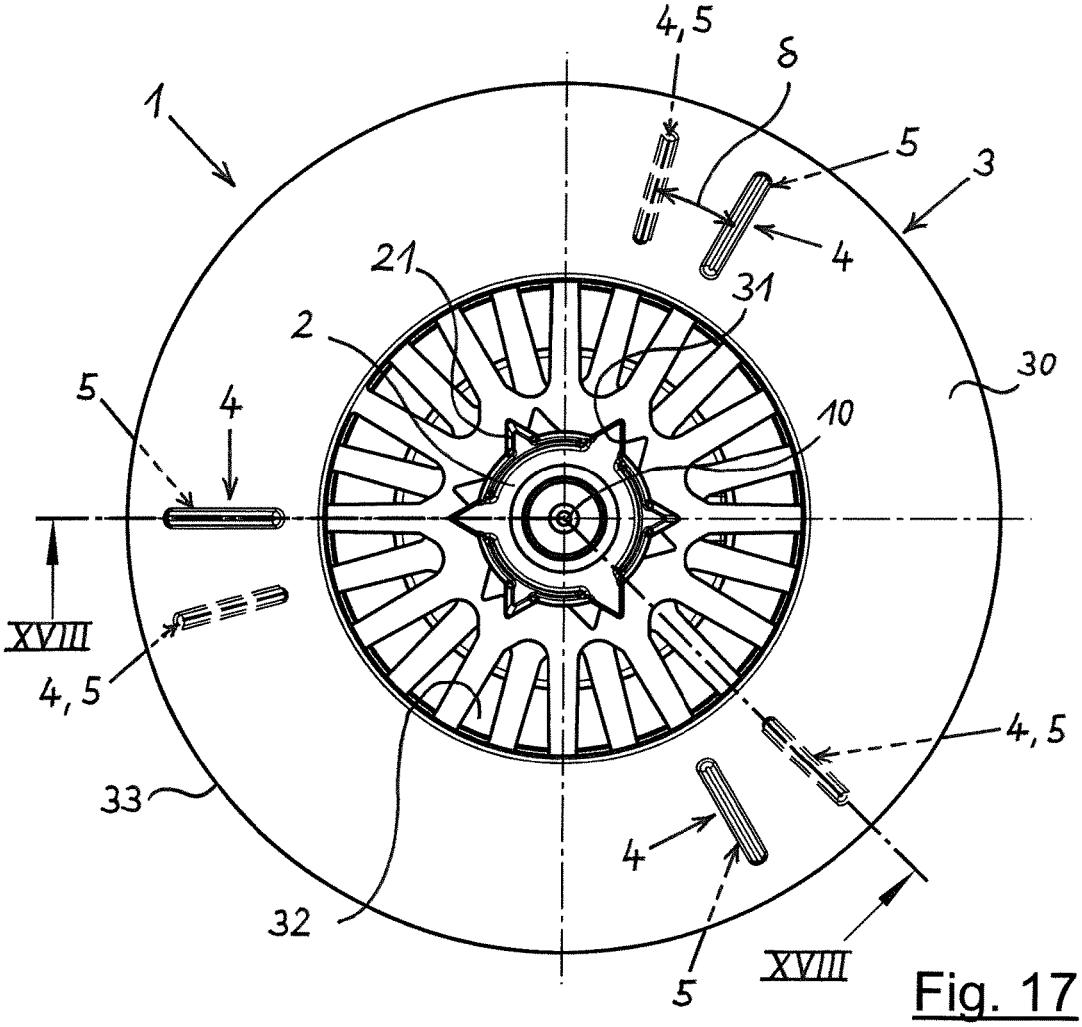
FIG. 17 shows a rotor made up of discs according to FIG. 16, in a plan view.
Figure 19:
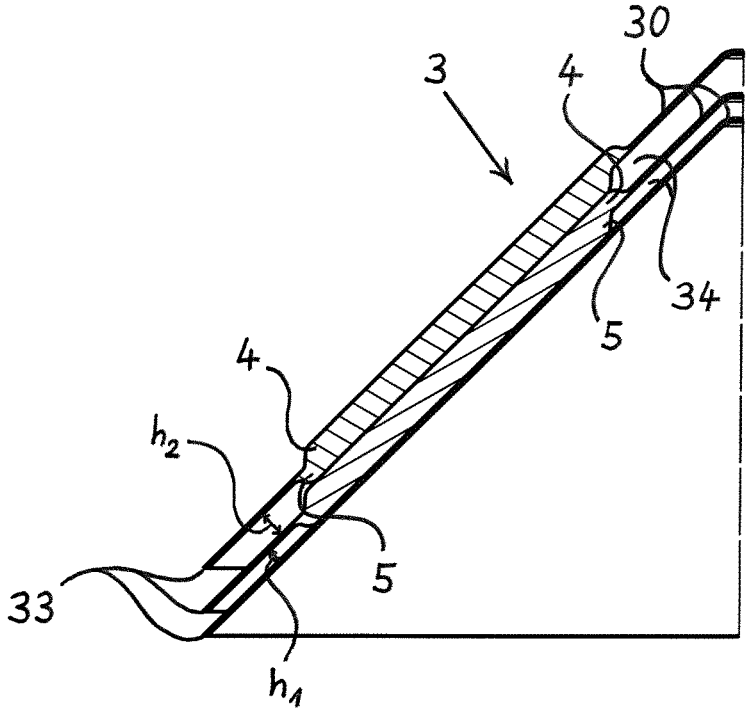
FIG. 19 shows the detail XIX enclosed by a box in FIG. 18, in an enlarged representation.
Figure 20:
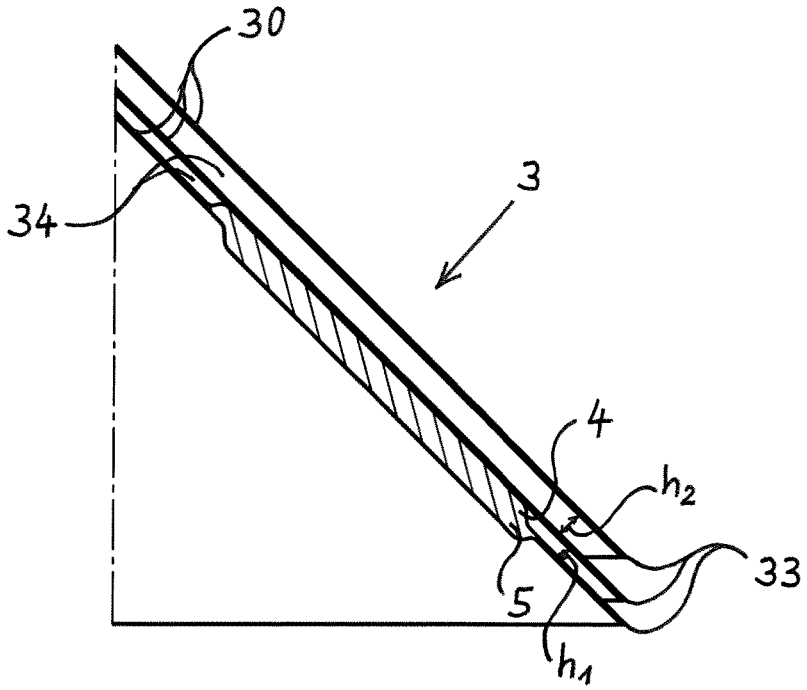
FIG. 20 shows the detail XX enclosed by a box in FIG. 18, in an enlarged representation.

If, as shown in FIG. 18, and shown in an enlarged view in FIGS. 19 and 20, in each case for the example of second and third disc 30 seen from above, the two discs 30 are configured in a rotational position relative to one another in disc stack 3 in which spacing elements 4, 5 of the two discs 30 are not situated so as to congruently overlap with one another, but rather are rotated out of congruent overlap relative to one another, then these two adjacent discs 30 have a smaller axial spacing, having a gap dimension h1 of intermediate flow gap 34.

If, as is shown at left in FIG. 18 and in an enlarged view in FIG. 19 for the example of first and second disc 30 seen from above, the two discs 30 are configured in a rotational position relative to one another in disc stack 3 in which the first spacing elements 4 of the one, here lower, disc 30 is situated so as to congruently overlap with second spacing elements 5 of the other, here upper, disc 30, then the two adjacent discs 30 have a larger axial spacing having a gap dimension h2 of intermediate flow gap 34.

In each of FIGS. 18 through 20, for clarity only a few discs 30 are shown; in practice, disc stacks 30 are made up of a significantly larger, often three-digit, number of discs 30.

Finally, FIGS. 21 through 24 show two different embodiments of central shaft 2, respectively in longitudinal section and in cross-section.

Figure 21:
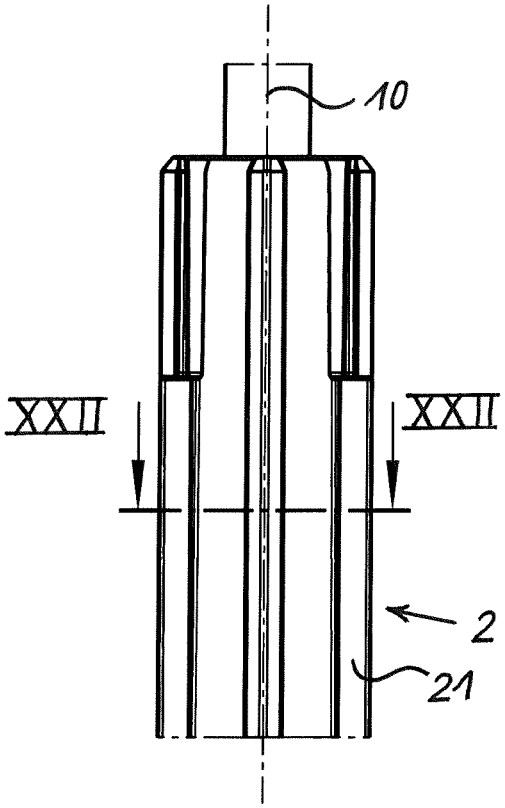
FIG. 21 shows an upper segment of a first central shaft as part of the rotor according to FIG. 17, in a side view.
Figure 22:
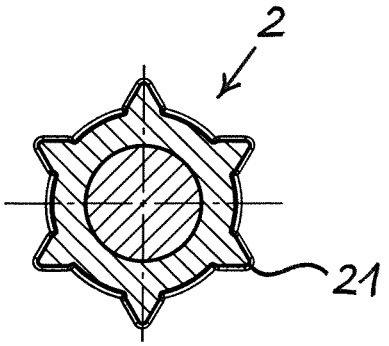
FIG. 22 shows the shaft of FIG. 21 in cross-section along sectional line XXII-XXII in FIG. 21.

In the first embodiment according to FIGS. 21 and 22, shaft 2 has on its outer circumference, as engagement contour 21 for the rotationally fixed accommodation of discs 30, six outward-pointing teeth that run parallel to one another in the shaft longitudinal direction and are situated at equal distances from one another in the circumferential direction of shaft 2.

In this first example of shaft 2, the spacing of the teeth of engagement contour 21 in the circumferential direction of shaft 2 is in each case 60°, and thus corresponds to the above-discussed grid angular distance α.

Figure 23:
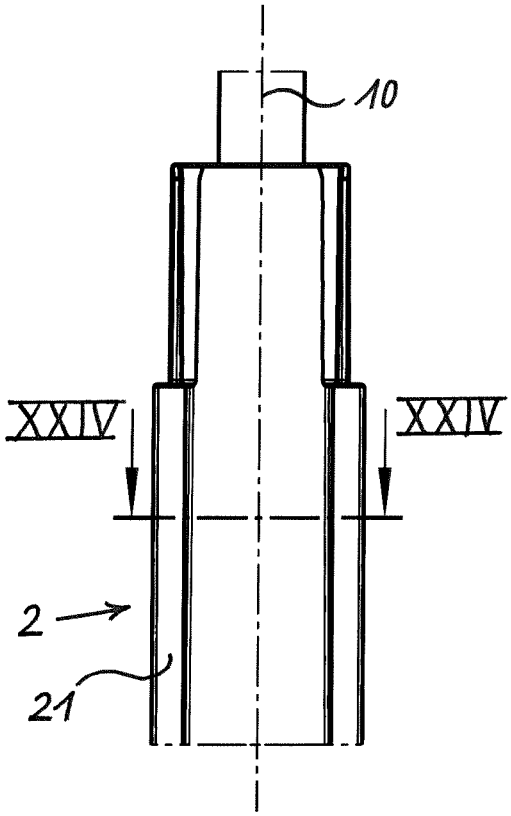
FIG. 23 shows an upper segment of a second, modified central shaft as part of a rotor, in a side view.
Figure 24:
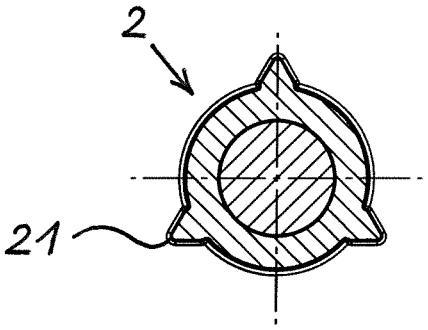
FIG. 24 shows the shaft of FIG. 23 in cross-section along sectional line XXIV-XXIV in FIG. 23.

In the second embodiment of shaft 2 according to FIGS. 23 and 24, shaft 2 has on its outer circumference, as engagement contour 21 for the rotationally fixed accommodation of discs 30, three outward-pointing teeth that run parallel to one another in the shaft longitudinal direction, and that are situated at equal distances from one another in the circumferential direction of shaft 2.

In this second example of shaft 2, the spacing of the teeth of engagement contour 21 in the circumferential direction of shaft 2 is in each case 120°, and thus corresponds to twice the above-discussed grid angular distance α.

Here, the number of teeth forming engagement contour 21 on shaft 2 has no influence on the number of possible relative engagement positions of central shaft 2 and discs 30. The concrete realization of engagement contour 21 and corresponding contour 31, e.g., the number and/or size of the teeth forming engagement contour 21 of shaft 2 and of the recesses, mating with the teeth and forming corresponding contour 31, on the inner circumference of the discs, is determined in particular according to the mechanical loads that occur between discs 30 and shaft 2 during operation of rotor 1.

With all embodiments described above of discs 30, having discs 30 that are completely identical to one another and identical central shafts 2, rotors 1 can be formed having disc stacks 30 whose discs 30 have different axial distances from one another, and that thus provide differently sized gap dimensions h for flow gaps 34.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

LIST OF REFERENCE CHARACTERS 1 rotor
10 axis of rotation
2 central shaft
21 engagement contour external on 2, matching 31
3 disc stack
30 discs
31 corresponding contour internal on 30, matching 21
32 flow openings in 30
33 radially outer edge of 30
34 flow gap
4 first spacing elements
5 second spacing elements
h, $h_1$, $h_2$ gap dimensions
α grid angular distance of 21, 31
β spacing element angular distance
δ offset angle

The invention claimed is:

1. A rotor of a centrifugal separator, comprising:
a central shaft;

a disc stack made up of a plurality of identical discs arranged on the central shaft, the central shaft having on an outer circumference an engagement contour for a rotationally fixed, axially slidable engagement with a corresponding contour on an inner circumference of the discs of the disc stack, the engagement contour and the corresponding contour being capable of being brought into engagement with one another in a plurality of rotational positions at a distance from one another in a rotor circumferential direction, and each disc having spacing elements situated at a distance from one another in a disc circumferential direction, which spacing elements hold each two adjacent discs at an axial distance from one another, forming an intermediate flow gap having a specifiable gap dimension, wherein the spacing elements of the discs are formed and configured such that, via different rotational positions relative to one another of adjacent discs in the disc stack, at least two different axial spacings having different gap dimensions of the flow gap between the adjacent discs are capable of being set.

2. The rotor according to claim 1, wherein the rotational positions at a distance from one another in the circumferential direction, in which the engagement contour and the corresponding contour can be brought into engagement with one another, are situated at a distance from one another in a uniform angle grid having a grid angular distance, the grid angular distance corresponding to a whole-number fraction of 360°.

3. The rotor according to claim 1, wherein the rotational positions at a distance from one another in the circumferential direction, in which the engagement contour and the corresponding contour can be brought into engagement with one another, lie in two angular grids superposed on one another and offset to one another in the circumferential direction by an offset angle, the two angular grids each having a uniform, agreeing grid angular distance, the grid angular distance corresponding to a whole-number fraction of 360°, and the offset angle being smaller than half the grid angular distance.

4. The rotor according to claim 1, wherein each disc has first and second spacing elements and wherein the first and second spacing elements differ in at least one of a height or in a radial position on the disc.

5. The rotor according to claim 4, wherein the first and second spacing elements are formed by two different bumps or beads molded or impressed into the discs, each bump or bead forming a raised part on one side of the disc and forming a recess on the other side of the disc.

6. The rotor according to claim 5, wherein the spacing elements situated at a distance from one another in the circumferential direction of the disc are each formed as individual bumps or as a radially running row of, in each case, a plurality of bumps.

7. The rotor according to claim 2, wherein each disc has first and second spacing elements and wherein the first and second spacing elements differ in at least one of a height or in a radial position on the disc, wherein the first and second spacing elements of each disc have an angular distance from one another in the circumferential direction, wherein the first spacing elements of each disc have an angular distance from one another that is twice as large in the circumferential direction, wherein the second spacing elements of each disc also have the angular distance from one another that is twice as large in the circumferential direction, and wherein the angular distance corresponds to the grid angular distance.

8. The rotor according to claim 1, wherein each disc has first and second spacing elements, and wherein the first and second spacing elements are formed by webs or nubs that are attached to or integrally formed on the discs and that form raised parts.

9. The rotor according to claim 8, wherein the webs or nubs forming the first spacing elements are situated on the upper side of the disc, and wherein the webs or nubs forming the second spacing elements are situated on the lower side of the disc, wherein the webs or nubs forming the first spacing elements are offset in the circumferential direction of the disc relative to the webs or nubs forming the second spacing elements.

10. The rotor according to claim 2, wherein each disc has first and second spacing elements, and wherein the first and second spacing elements are formed by webs or nubs that are attached to or integrally formed on the discs and that form raised parts, wherein the webs or nubs forming the first spacing elements are situated on the upper side of the disc, wherein the webs or nubs forming the second spacing elements are situated on the lower side of the disc, wherein the webs or nubs forming the first spacing elements are offset in the circumferential direction of the disc relative to the webs or nubs forming the second spacing elements, wherein the first and second spacing elements of each disc have an angular distance from one another in the circumferential direction, wherein the first spacing elements of each disc have an angular distance from one another that is twice as large in the circumferential direction, wherein the second spacing elements of each disc also have the angular distance from one another that is twice as large in the circumferential direction, and wherein the angular distance corresponds to the grid angular distance.

11. The rotor according to claim 8, wherein the rotational positions at a distance from one another in the circumferential direction, in which the engagement contour and the corresponding contour can be brought into engagement with one another, are situated at a distance from one another in a uniform angle grid having a grid angular distance, the grid angular distance corresponding to a whole-number fraction of 360°, wherein the webs or nubs forming the first spacing elements are situated on the upper side of the disc, and wherein the webs or nubs forming the second spacing elements are situated on the lower side of the disc, wherein the webs or nubs forming the first spacing elements are configured so as to congruently overlap with the webs or nubs forming the second spacing elements, and wherein the angular distance of the spacing elements situated at a distance from one another in the circumferential direction of the discs corresponds to twice the grid angular distance.

12. The rotor according to claim 8, wherein the webs or nubs forming the first spacing elements and situated on the upper side of the disc and the webs or nubs forming the second spacing elements and situated on the lower side of the disc are identical to one another.

13. The rotor according to claim 1, wherein within the disc stack of a first arrangement of the rotor, all discs have a first, smaller axial distance from one another, having a smaller gap dimension, and wherein within the disc stack of a second arrangement of the rotor, having discs identical to the first arrangement of the rotor, all discs have a second, larger axial distance from one another, having a larger gap dimension.

14. The rotor according to claim 1, wherein the discs within the disc stack of the rotor have different axial spacings, specifically, in a region of the rotor close to an inflow, a smaller axial distance from one another with a smaller gap dimension, and, in a region of the rotor remote from the inflow, a larger axial distance from one another with a larger gap dimension.

15. The rotor according to claim 2, wherein the engagement contour and the corresponding contour are configured to be brought into engagement with one another in from two to sixteen rotational positions at a distance from one another in the circumferential direction of the central shaft and of the discs.

16. The rotor according to claim 1, wherein the discs are press-stamped parts made of sheet metal, or are injection-molded parts made of plastic.

17. The rotor according to claim 1, wherein the engagement contour on the outer circumference of the shaft is formed by a number of teeth that run in a longitudinal direction of the shaft and that protrude radially outward, and wherein the corresponding contour on the inner circumference of the discs is formed by a number of recesses being equal to or double the number of teeth and that mate with the teeth and point radially outward.

18. The rotor according to claim 17, wherein the number of teeth is between 2 and 8.

19. A centrifugal separator comprising a rotor according to claim 1.

20. The centrifugal separator according to claim 19, comprising an oil mist separator for crankcase ventilation gas of an internal combustion engine.

* * * * *